US008534973B2

(12) United States Patent
Babej et al.

(10) Patent No.: US 8,534,973 B2
(45) **Date of Patent: *Sep. 17, 2013**

(54) METHOD FOR PRODUCING HOLLOW BODY ELEMENTS, HOLLOW BODY ELEMENT, COMPONENT, FOLLOW-ON COMPOSITE TOOL FOR PRODUCING HOLLOW BODY ELEMENTS

(75) Inventors: Jiri Babej, Lich (DE); Michael Vieth, Bad Vilbel (DE); Richard Humpert, Bad Nauheim (DE)

(73) Assignee: Profil Verbindungstechnik GmbH & Co., KG, Friedrichsdorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/372,830

(22) Filed: Feb. 14, 2012

(65) Prior Publication Data

US 2012/0141224 A1 Jun. 7, 2012

Related U.S. Application Data

(62) Division of application No. 11/915,210, filed on Feb. 13, 2008, now Pat. No. 8,123,446.

(30) Foreign Application Priority Data

May 25, 2005 (DE) ..... 10 2005 024 220
May 24, 2006 (WO) ..... PCT/EP2006/004977

(51) Int. Cl.
*F16B 37/12* (2006.01)

(52) U.S. Cl.
USPC ..... 411/181; 411/427; 411/180

(58) Field of Classification Search
USPC ..... 411/179–181, 427
See application file for complete search history.

(56) References Cited

U.S. PATENT DOCUMENTS 2,096,623 A 4/1935 Almdale
2,206,740 A 7/1940 Burke et al.

(Continued)

FOREIGN PATENT DOCUMENTS

DE 671 536 2/1939
DE 2 111 524 10/1971

(Continued)

OTHER PUBLICATIONS

German search report of Oct. 19, 2005 for German Application No. 10 2005 024 220.0 and translation thereof.

(Continued)

*Primary Examiner* — Gary Estremsky
(74) *Attorney, Agent, or Firm* — Hershovitz & Associates, PLLC; Abraham Hershkovitz; Eugene C. Rzucidlo

(57) ABSTRACT

The invention relates to a method for producing hollow body elements (200), for example, nut elements which are applied to components which are normally made of steel (280), in particular, for producing hollow body elements having an essentially quadratic or rectangular external profile (202). Said method consists of cutting individual elements of a profile in the form of a profile rod (1) or a winding after holes (204) have previously been stamped in the profile, a threaded cylinder (206) is subsequently, optionally, formed using a follow-on composite tool (10) which consists of several working stations. The invention is characterized in that a penetrating process and a punching process are carried out in the working station. The invention also relates to hollow body elements (200), components, follow-on composite tools (10) and rolling mills (600, 602).

16 Claims, 28 Drawing Sheets

(56) References Cited

U.S. PATENT DOCUMENTS

| | | | | |
|---|---|---|---|---|
| 3,775,791 | A | 12/1973 | Grube | |
| 3,999,659 | A | 12/1976 | Grube | |
| 4,690,599 | A | 9/1987 | Shinjo | |
| 4,971,499 | A | 11/1990 | Ladouceur | |
| 5,531,552 | A | 7/1996 | Takahashi et al. | |
| 7,001,125 | B2 * | 2/2006 | Wojciechowski et al. | 411/180 |
| 2004/0042870 | A1 | 3/2004 | Parker et al. | |
| 2004/0042872 | A1 | 3/2004 | Ward et al. | |
| 2005/0166381 | A1 | 8/2005 | Babej et al. | |
| 2007/0175262 | A1 | 8/2007 | Babej et al. | |

FOREIGN PATENT DOCUMENTS

| | | | |
|---|---|---|---|
| DE | 32 47 555 | C2 | 7/1983 |
| DE | 695 07 348 | T2 | 6/1999 |
| DE | 202 05 192 | U1 | 12/2002 |
| DE | 101 15 420 | A1 | 10/2004 |
| DE | 10 2004 045 159 | A1 | 9/2005 |
| EP | 0 663 247 | A1 | 7/1995 |
| EP | 1 559 488 | A2 | 8/2005 |
| GB | 551 845 | | 3/1943 |
| GB | 1 373 633 | | 11/1974 |
| GB | 1 472 751 | | 5/1977 |
| GB | 2 008 449 | A | 6/1979 |
| WO | WO 01/28723 | A1 | 4/2001 |
| WO | WO 01/72449 | A2 | 10/2001 |
| WO | WO 2004/050269 | A2 | 6/2004 |
| WO | WO 2005/099930 | A1 | 10/2005 |

OTHER PUBLICATIONS

International Search Report of Oct. 2, 2005 for PCT/EP2006/004977.
English Translation of the International Report on Patentability which was mailed on May 15, 2008 with the Notification of Transmittal of Translation of the IRP.

* cited by examiner

FIG. 5E
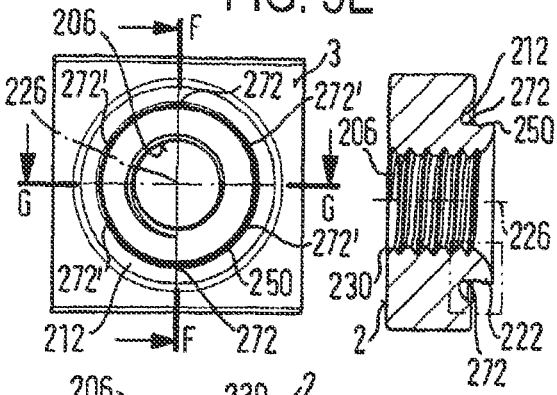
FIG. 5J
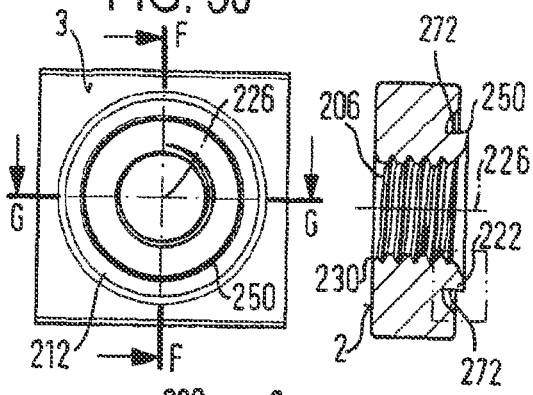
FIG. 5F
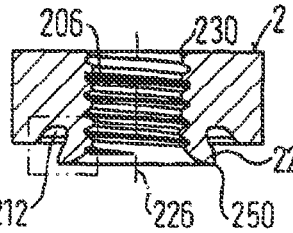
FIG. 5G
FIG. 5K
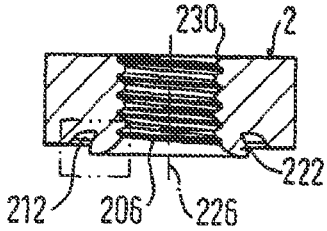
FIG. 5L
FIG. 5H
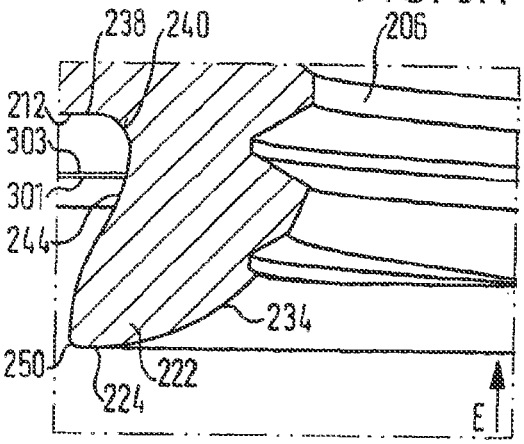
FIG. 5M
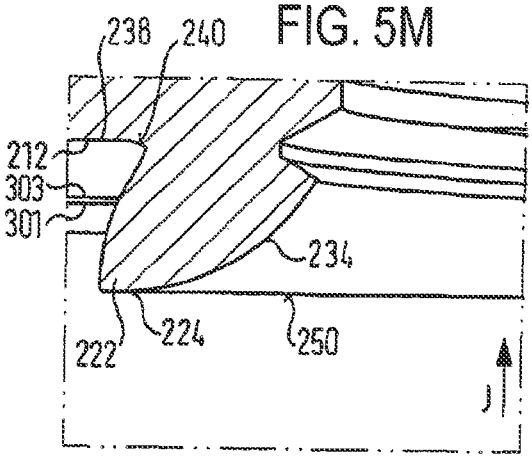
FIG. 5I
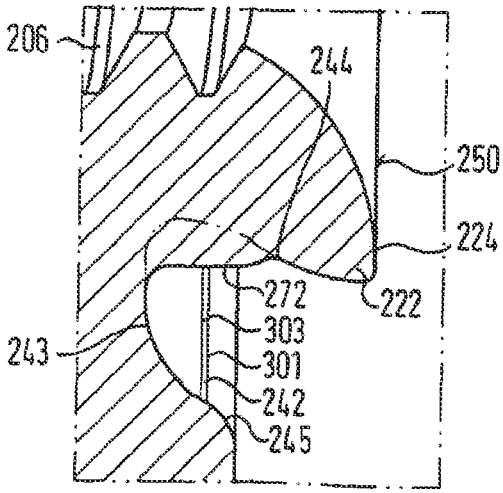
FIG. 5N
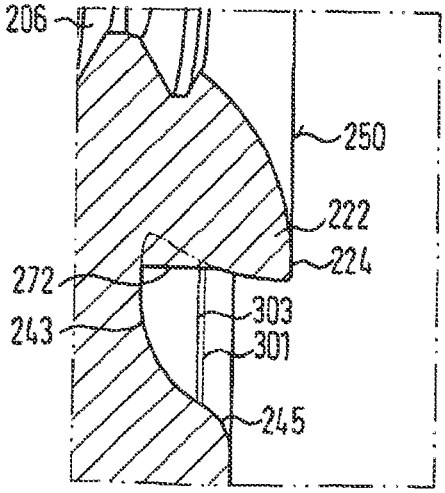

FIG. 8A
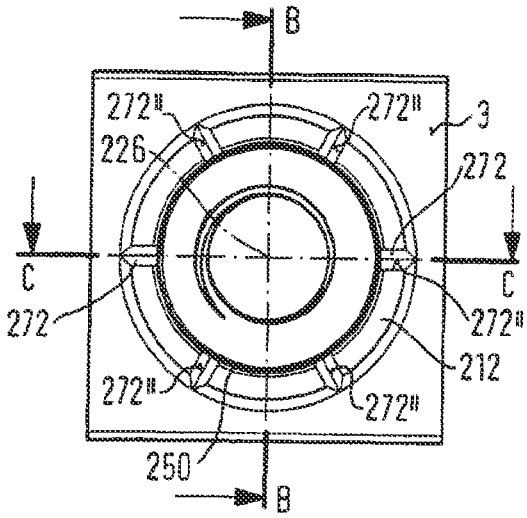
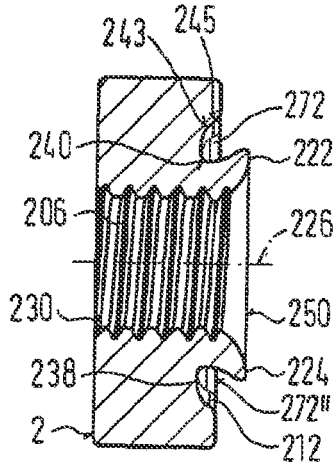
FIG. 8B
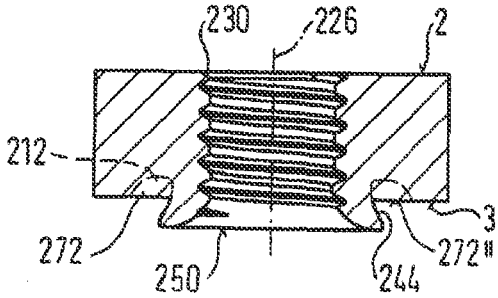
FIG. 8C
FIG. 8D
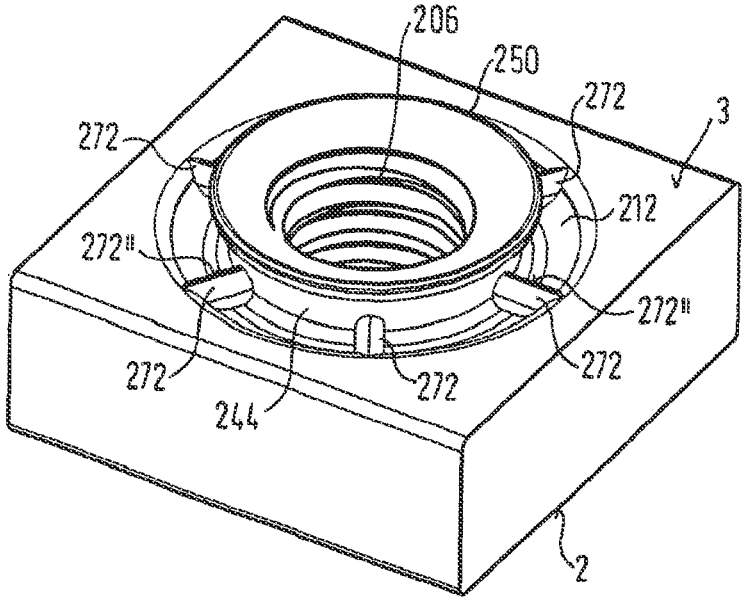

FIG. 9A
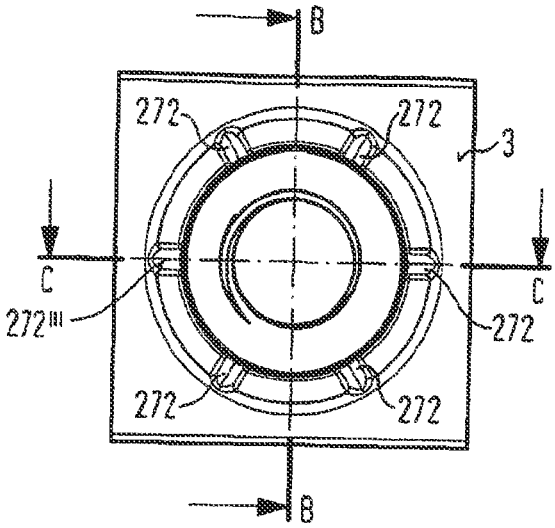
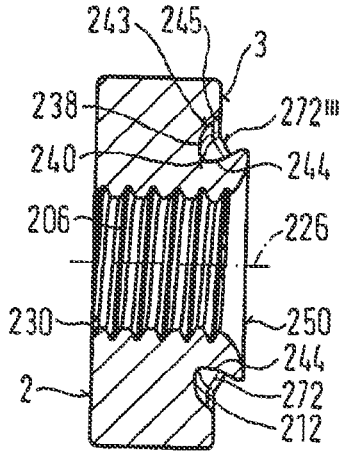
FIG. 9B
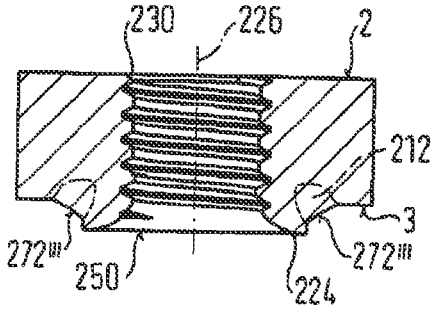
FIG. 9C
FIG. 9D
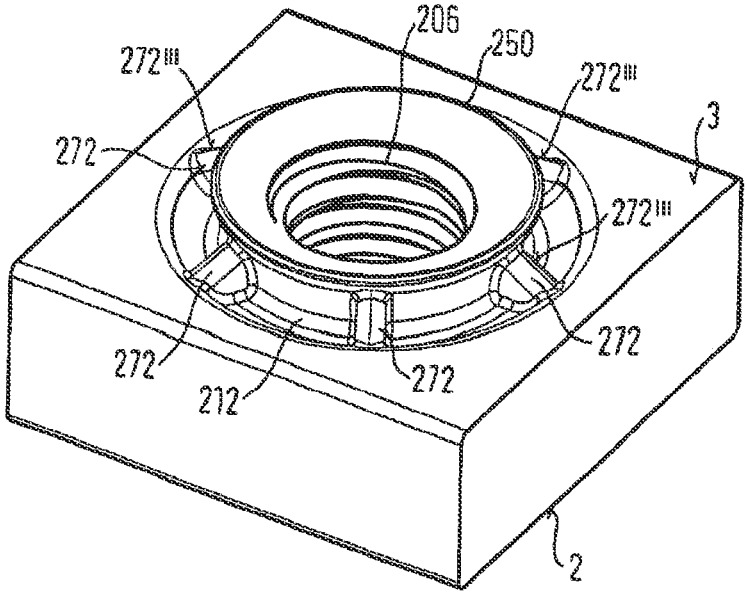

FIG. 10A
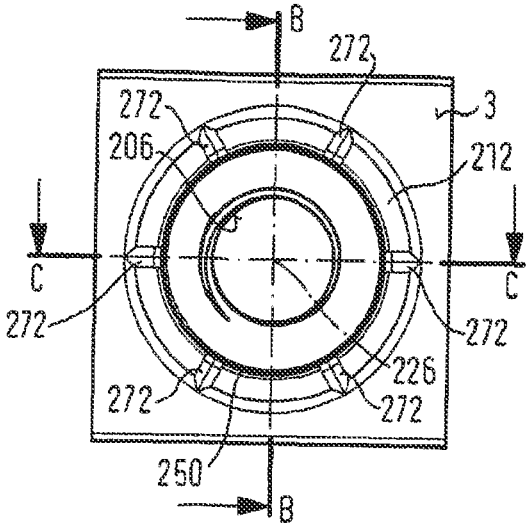
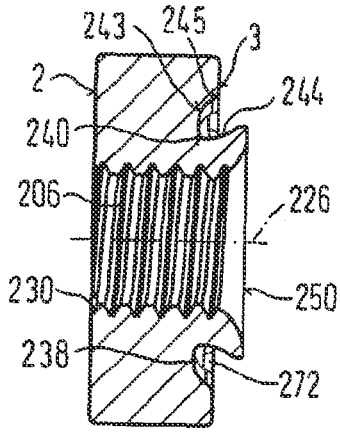
FIG. 10B
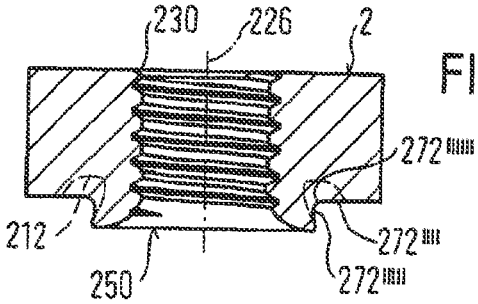
FIG. 10C
FIG. 10D
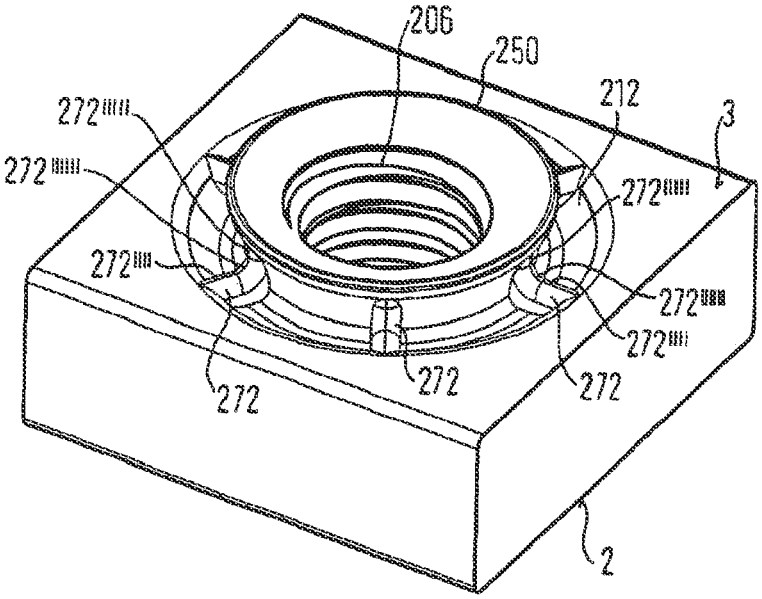

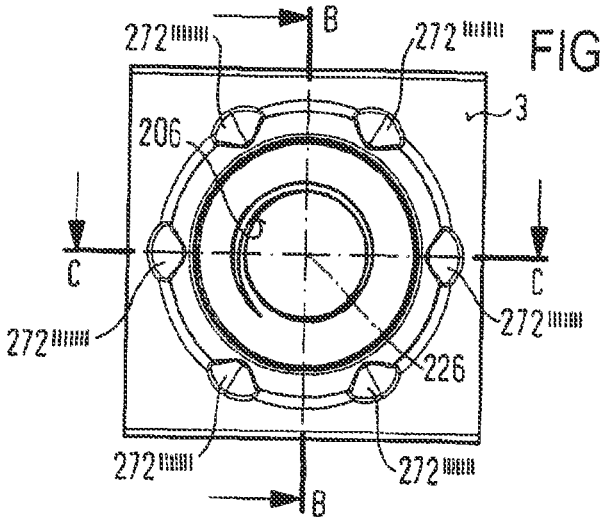
FIG. 11A
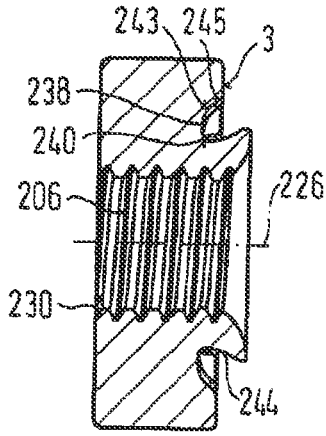
FIG. 11B
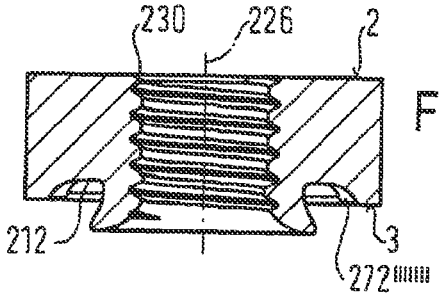
FIG. 11C
FIG. 11D
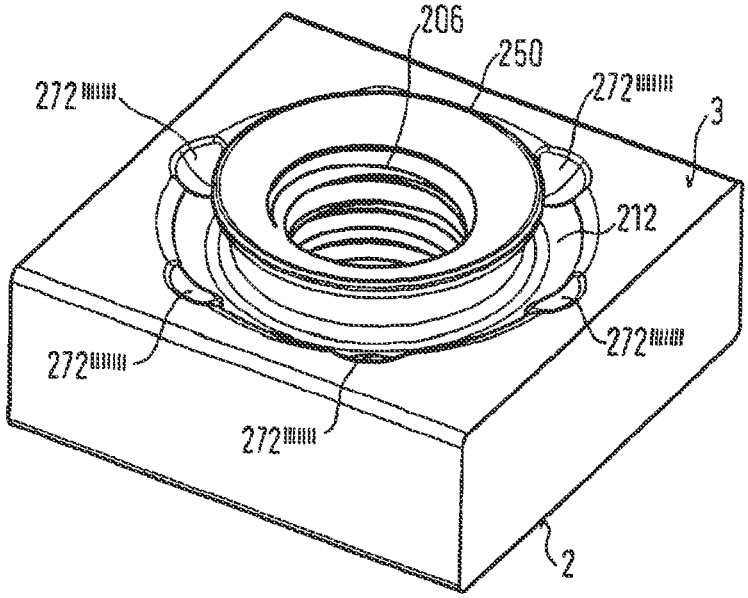

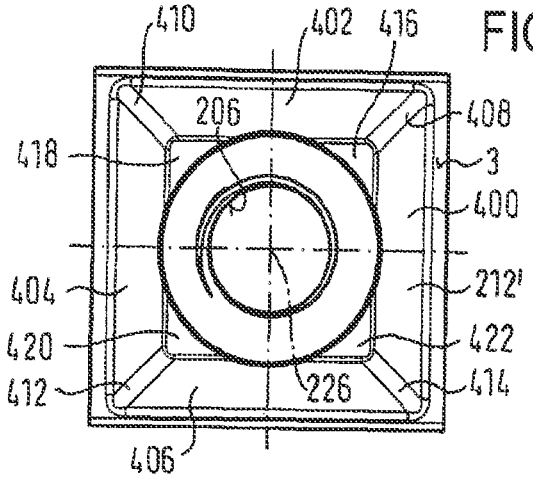
FIG. 12A
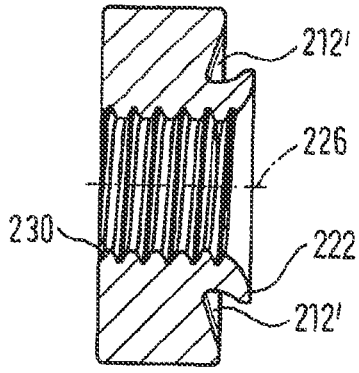
FIG. 12B
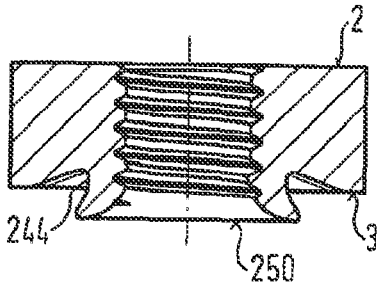
FIG. 12C
FIG. 12D
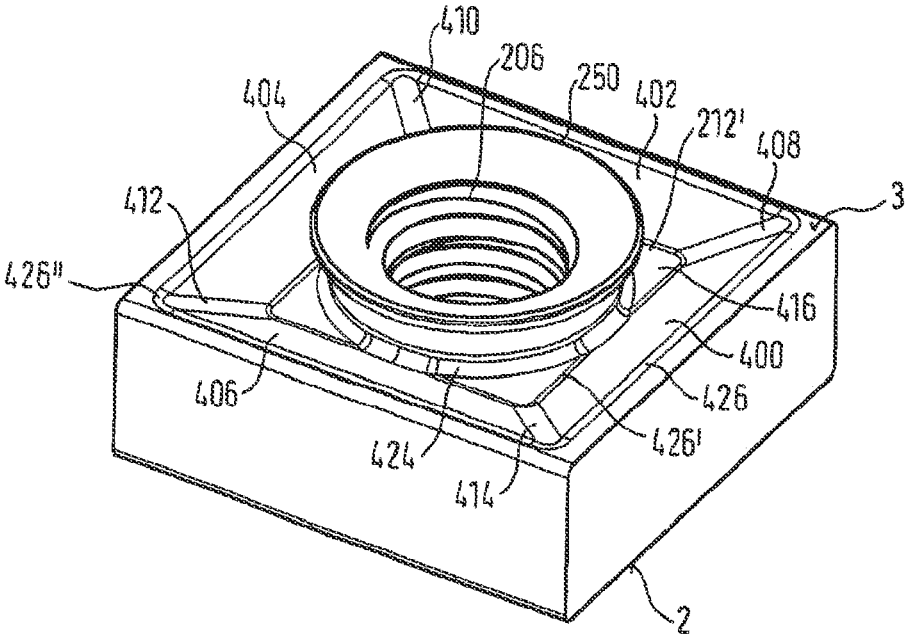

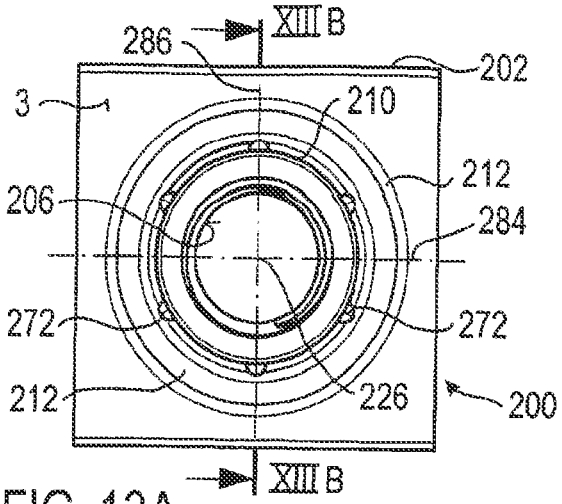
FIG. 13A
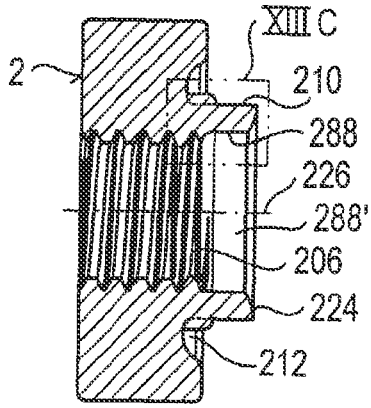
FIG. 13B
FIG. 13C
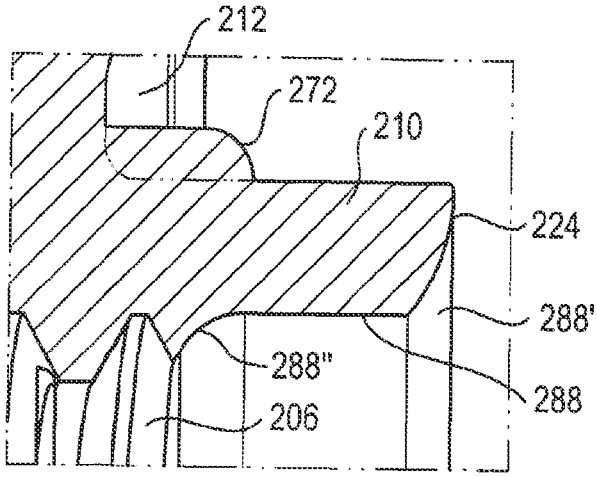
FIG. 13D
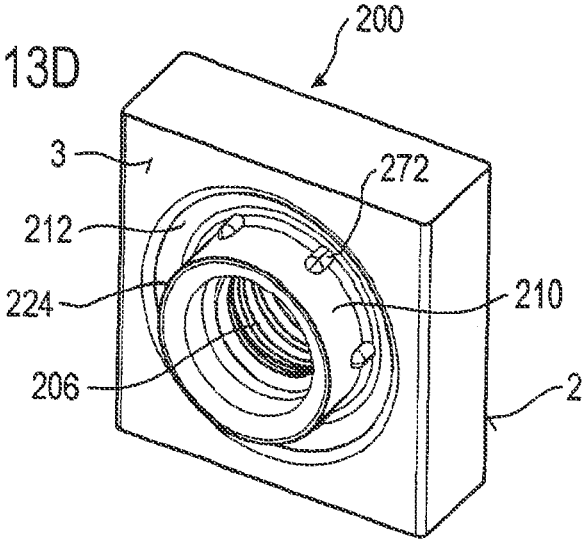

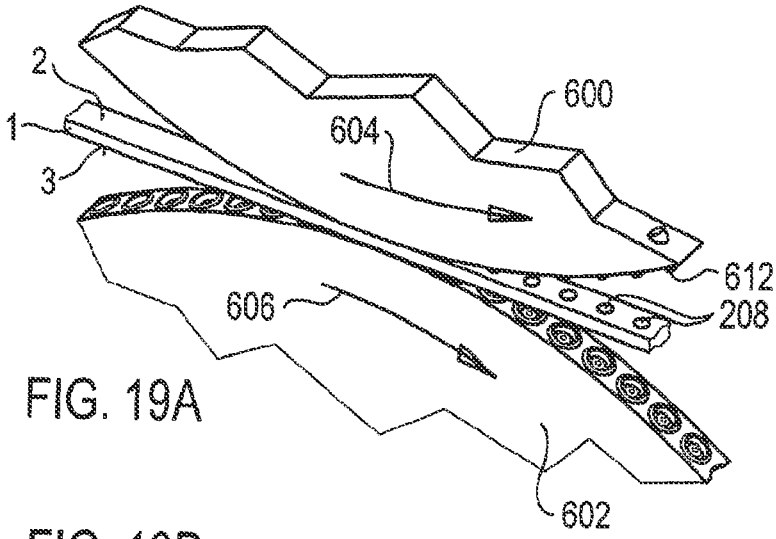
FIG. 19A
FIG. 19B
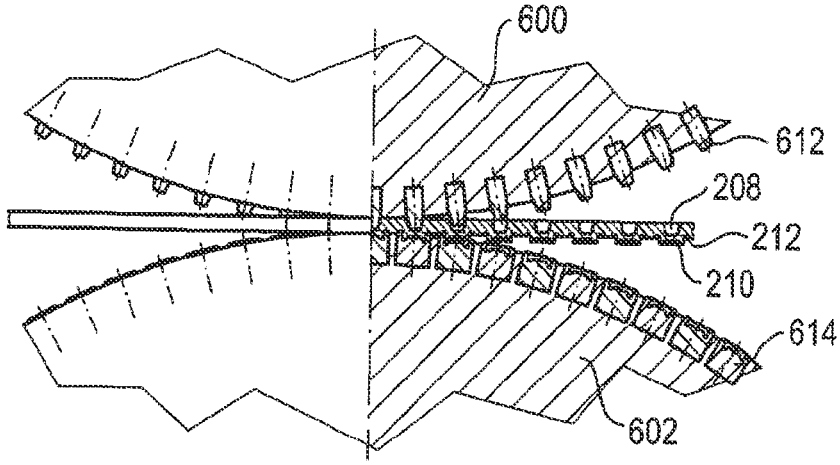
FIG. 19C
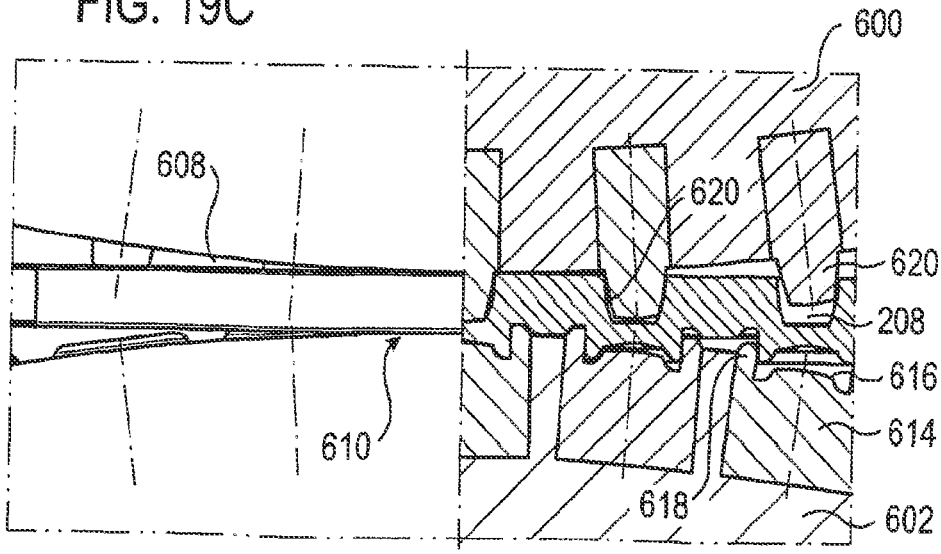

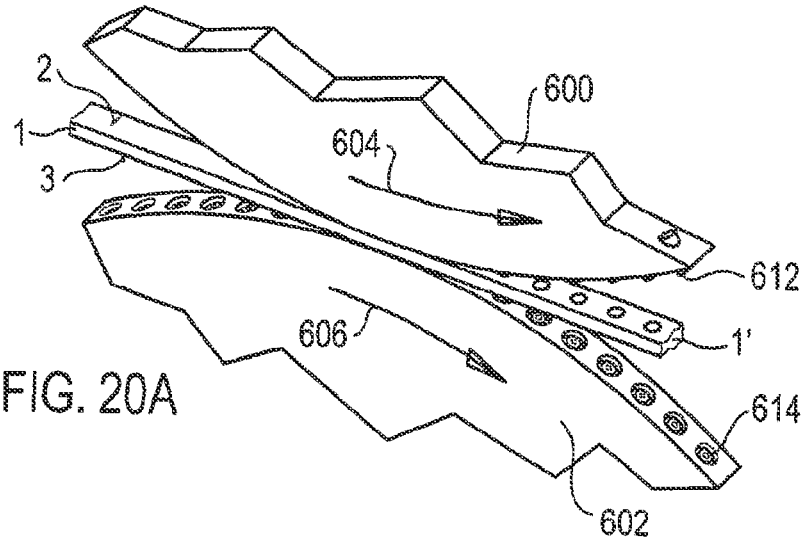
FIG. 20A
FIG. 20B
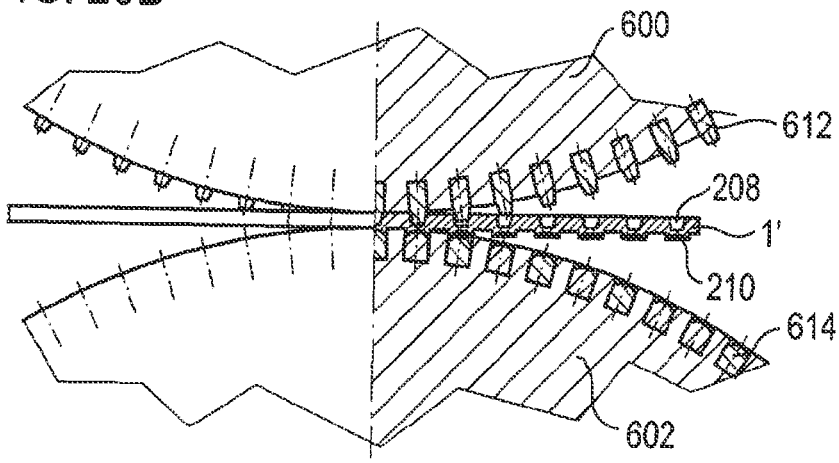
FIG. 20C
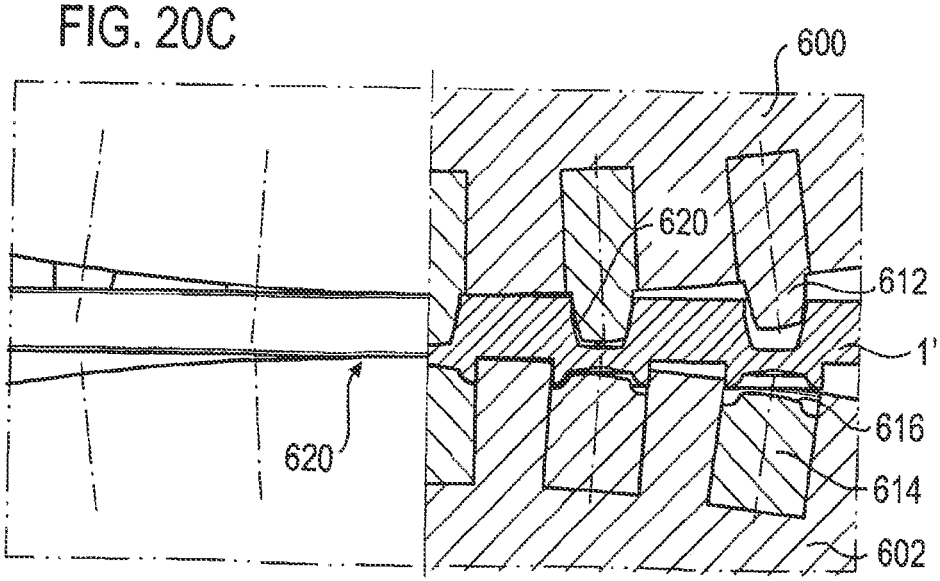

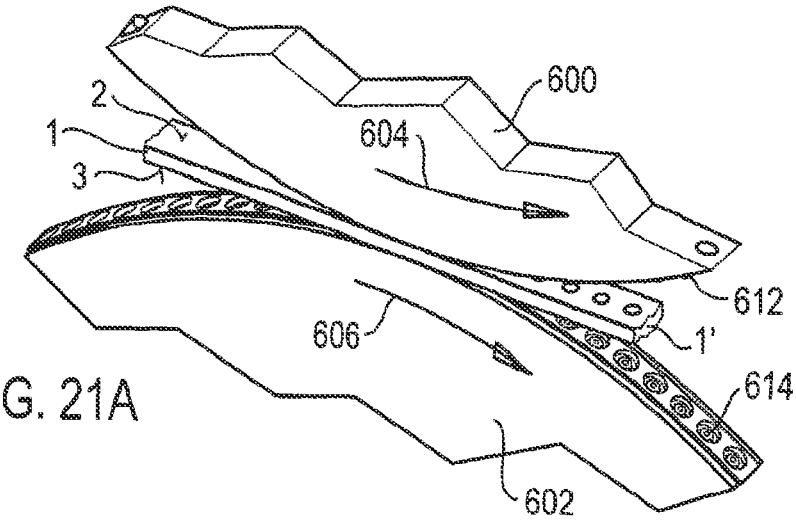
FIG. 21A
FIG. 21B
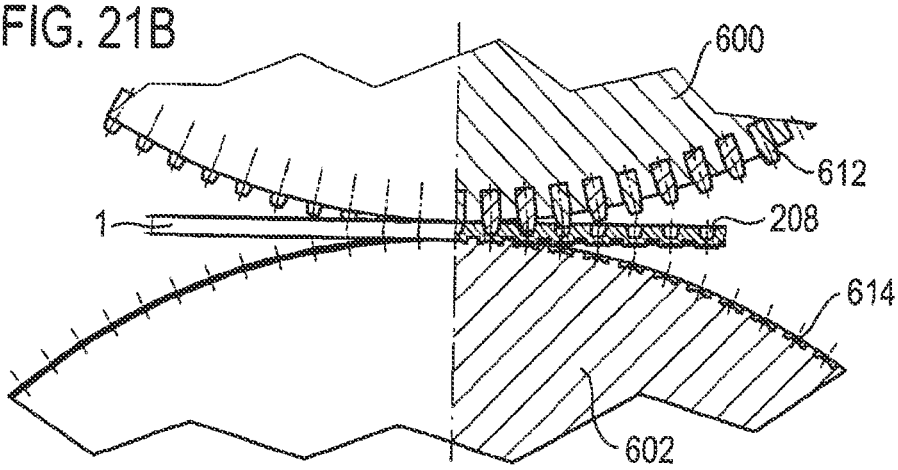
FIG. 21C
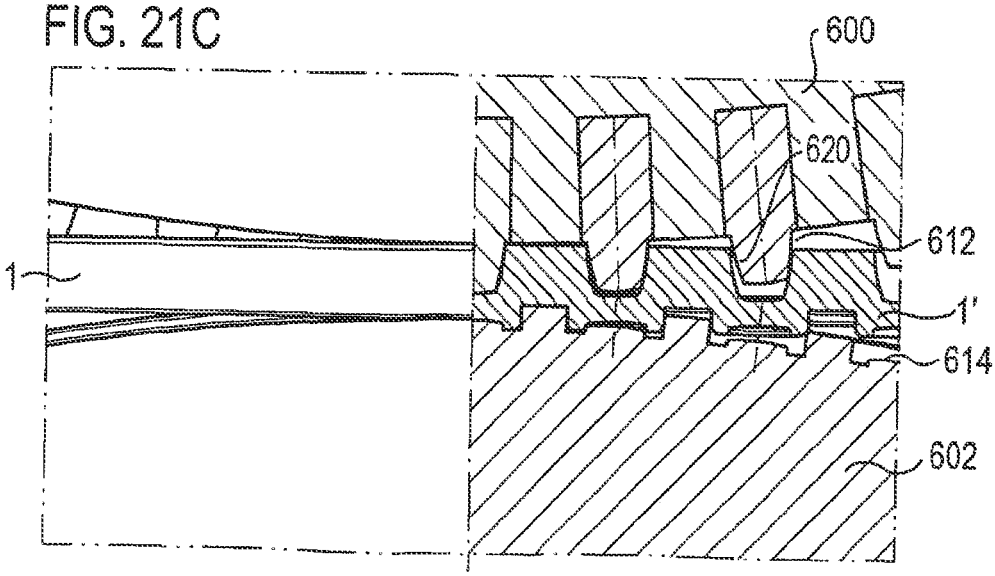

FIG. 22A
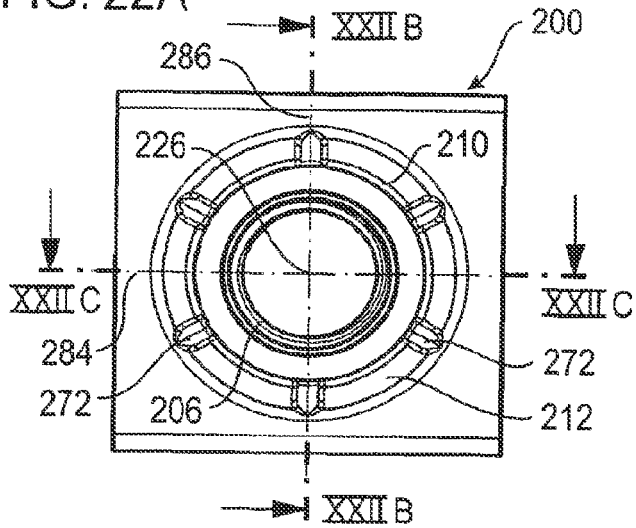
FIG. 22B
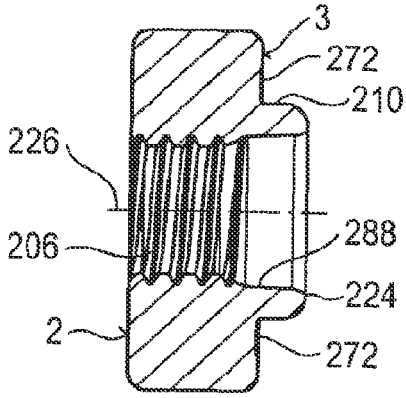
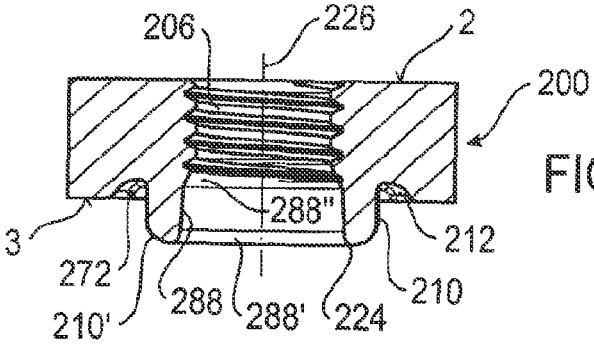
FIG. 22C
FIG. 22D
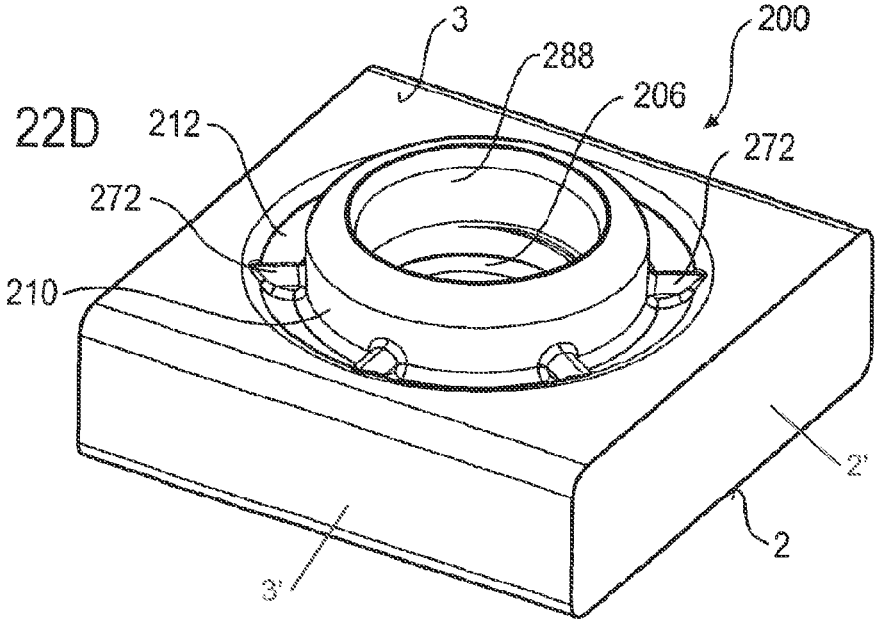

METHOD FOR PRODUCING HOLLOW BODY ELEMENTS, HOLLOW BODY ELEMENT, COMPONENT, FOLLOW-ON COMPOSITE TOOL FOR PRODUCING HOLLOW BODY ELEMENTS

CROSS REFERENCE OF APPLICATION

This application is a divisional of Ser. No. 11/915,210, filed Feb. 13, 2008, pending, which claims the benefit of priority from PCT/EP06/004977 filed on May 24, 2006 and from German Patent Application No. 10 2005 024 220.0, filed on May 25, 2005, the disclosures of which are expressly incorporated by reference herein in their entireties.

FIELD OF THE INVENTION

The present invention relates to a method for the manufacture of hollow body elements such as nut elements for attachment to components normally consisting of sheet metal, in particular, for the manufacture of hollow body elements having an at least substantially square or rectangular external outline by cutting individual elements by length from a section present in the form of a bar section or of a coil after prior piercing of holes into the section, optionally with subsequent formation of a thread cylinder, by using a progressive tool having a plurality of working stations in which respective operations are carried out. Furthermore the present invention relates to hollow body elements which are manufactured in accordance with the method, to component assemblies which consist of a hollow body element and a sheet metal part and also progressive tools for carrying out the method and rolling mechanisms which can be used in combination with the progressive tools.

BACKGROUND OF THE INVENTION

A method of the initially named kind and also corresponding hollow body elements and component assemblies are for example known in the non-prior published application PCT/EP2005/003893 of Apr. 13, 2005. It is the object of the present invention to so further develop the method of the initially named kind that hollow body elements, in particular rectangular nut elements can be manufactured at favorable prices without having to load the tools that are used such that they fail prematurely. Furthermore the hollow body elements that are manufactured in this way should have excellent mechanical characteristics, for example a high pull-out force, an excellent security against rotation and should moreover show a reduced notch effect, so that the fatigue characteristics of component assemblies comprising a component normally consisting of sheet metal and hollow body elements mounted thereon can be improved also under dynamic loads. Furthermore, the hollow body elements should be capable of being manufactured at an extremely favorable price. Moreover, a particularly advantageous design of a progressive tool used in the manufacture of hollow body elements and also of a rolling mechanism for the purpose of manufacturing hollow body elements should be made available in accordance with the invention.

SUMMARY OF THE INVENTION

The object in accordance with the invention is satisfied by a method in accordance with the present method claims, by a hollow body element in accordance with the element claims, by a component assembly in accordance with the assembly claims, by a progressive tool in accordance with the tool claims and by a rolling mechanism in accordance with the mechanism claims.

In the method of the invention the section that is used has a rectangular cross-section and is thus inexpensive to manufacture. Through the manufacturing method in accordance with the invention it is possible to manufacture hollow body elements without the tools that are used being subjected to a high degree of wear and without the plungers that are used failing prematurely. Furthermore, the problem of the elongation of the sectional strip in the progressive tool is overcome in a highly effective manner in that, depending on the design of the ingoing sectional strip only one reforming station or at most two reforming stations are required in the progressive tool, i.e., in accordance with the invention, a station for the formation of an under-cut at the pilot portion of the hollow body element is no longer required in comparison to the initially named application PCT/EP2005/003893.

The advantage of the invention of PCT/EP2005/003893 in accordance with which the manufacture takes place in working steps in which two processing operations are always carried out for one section in one station is however retained. This leads to the productivity of the manufacturing plant being doubled without the cost and complexity for the manufacture of the progressive tool rising by an amount which is no longer reasonable. The doubling of the working elements does indeed require a certain degree of additional cost and complexity, this can however be straightforwardly amortized relatively early on via corresponding manufacturing quantities.

It is admittedly possible to process a plurality of sections in parallel in one progressive tool, this is however not necessarily preferred because if problems occur with one section, or with the progressing of one section the entire progressive tool has to be stopped until the break-down has been remedied, whereby considerable production losses could arise. Nevertheless the present invention could be realized using a progressive tool which simultaneously processes a plurality of sections.

Particularly preferred embodiments of the method of the invention, of the hollow body elements in accordance with the invention, of the component assemblies in accordance with the invention and also of the progressive tool in accordance with the invention can be found from the further patent claims.

Further advantages of the method of the invention, of the hollow body elements of the invention, and also of the progressive tool used in accordance with the invention can be found in the Figures and in the subsequent description of the Figures.

BRIEF DESCRIPTION OF THE DRAWINGS

The Figures show, in FIGS. 1 to 12, the same Figures which are shown in PCT/EP2005/003893, which are useful for an understanding of the present invention which builds on the existing invention, and also show FIGS. 13 to 21 which explain the present invention more precisely. Specifically there are shown:

FIGS. 13A-13D representations of a hollow body element of the invention which represents a modification of the hollow body element in accordance with FIGS. 5A-5D with the FIG. 13A showing a view from below of the free end face of the hollow body element, FIG. 13B showing a sectional drawing corresponding to the section plane X111B-X111B of FIG. 13A, FIG. 13C showing an enlarged representation of the region X111C of FIG. 13B and FIG. 13D reproduces the hollow body element in a perspective illustration, FIGS. 14A-14D the attachment of the hollow body element in accordance with the invention to a pre-pierced sheet metal part by a riveting process, FIG. 15 a longitudinal section to a progressive tool in accordance with the invention which is similar to the progressive tool of FIG. 3, FIG. 16 an enlarged representation of the central region of the progressive tool of FIG. 15, FIG. 17 a longitudinal section through a further progressive tool in accordance with the invention which is similar to the progressive tool of FIG. 15, FIG. 18 an enlarged representation of the central region of the progressive tool of FIG. 17, FIGS. 19A-19C a schematic representation of a first rolling mechanism in accordance with the invention, FIGS. 20A-20C a schematic representation of a second rolling mechanism in accordance with the invention, FIGS. 21A-21C a schematic representation of a third rolling mechanism in accordance with the invention, FIGS. 22A-22D representations of a further hollow body element in accordance with the invention, with the FIG. 22A representing a view from below, FIG. 22B representing a sectional drawing corresponding to the section plane XXIIB-XXIIB of FIG. 22A, FIG. 22C representing a sectional drawing corresponding to the sectional drawing corresponding to the section plane XXIIIC-XXIIC of FIG. 22A and FIG. 22D representing a perspective view, FIGS. 23A-23D views to explain the attachment of the element of FIGS. 22A-22D to a relatively thin sheet metal part (FIG. 23A), FIGS. 24A-24D views corresponding to FIGS. 23A-23D but to explain the attachment of the element to a relatively thick sheet metal part (FIG. 24A), FIGS. 25A-25F a series of drawings to explain the manufacture of the element of the invention in accordance with FIGS. 22A-22D, FIG. 26 a side view of a progressive tool sectioned in the longitudinal direction of the sectional strip for the manufacture of the elements in accordance with FIGS. 22A-22D and FIG. 27 an enlarged representation of the central region of the progressive tool of FIG. 26.

DETAILED DESCRIPTION OF THE DRAWINGS

Figure 1:
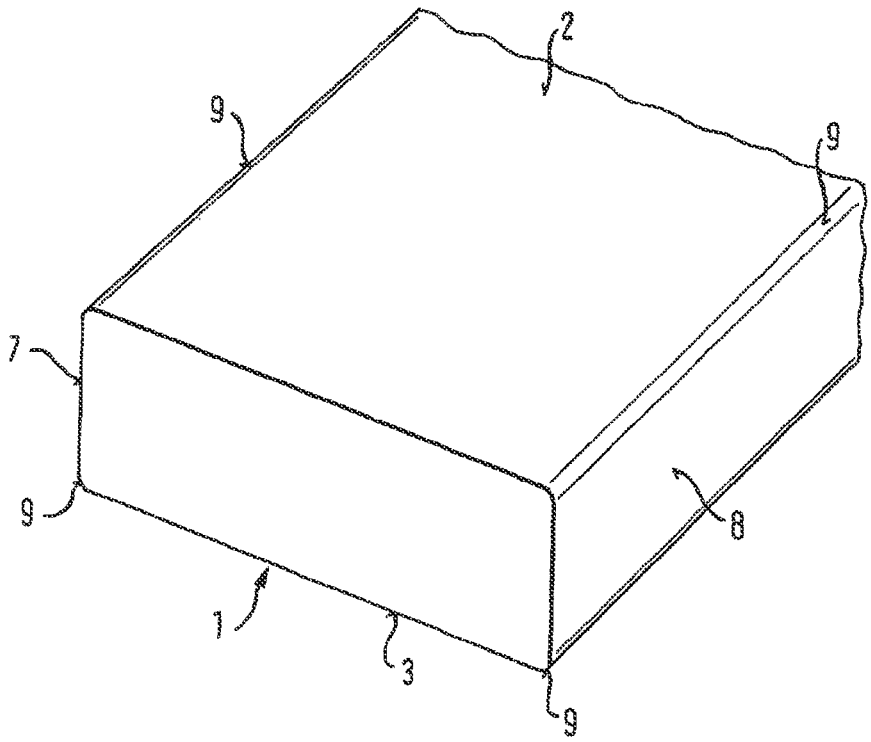
FIG. 1 an embodiment of a section which is processed in a progressive tool in accordance with FIG. 2, with FIG. 2 a reproduction of a representation of a progressive tool section in the direction of movement of the section, FIG. 3 an enlarged representation of the progressive tool of FIG. 2 in the region of the working stations, FIGS. 4A-4E a representation of the individual steps for the manufacture of a hollow body element using the method and the progressive tool of the FIGS. 2 and 3, FIGS. 5A-5N various representations of the finished hollow body element of the FIGS. 4A-4E, with FIG. 5A showing a perspective representation of the hollow body element from below, FIG. 5B a plan view of the hollow body element from above, FIG. 5C a sectional drawing corresponding to the section plane C-C and C'-C' of FIG. 5B and FIG. 5D an enlarged representation of the region D of FIG. 5C, with the further FIGS. 5E-5I showing an ideal variant of the hollow body element of FIGS. 5A-5D and indeed designed for a thicker sheet metal parts, whereas the FIGS. 5J-5N show a further ideal variant which is designed for use with thinner sheet metal parts, FIGS. 6A-6E representations of a further hollow body element which represents a slight modification of the hollow body elements in accordance with FIGS. 5A-5D, with FIG. 6A showing a plan view of the hollow body element from above, FIG. 6B a section drawing along the section plane B-B of FIG. 6A, FIG. 6C reproduces a section drawing corresponding to the section plane C-C of FIG. 6A and FIGS. 6D and 6E are perspective representations of the functional elements from above and below, FIGS. 7A-7B the attachment of the hollow body element to a thin sheet metal part and to a thicker sheet metal part respectively, FIGS. 8A-8D representations of a further variant of a hollow body element with features providing security against rotation in the form of radially extending ribs which bridge the ring recess, with FIG. 8A being a view of the hollow body element from below, the FIGS. 8B and 8C being section drawings corresponding to the horizontal section plane B-B and to the vertical section plane C-C of FIG. 8A, and the FIG. 8D being a perspective drawing, FIGS. 9A-9D representations corresponding to FIGS. 8A-8D, but of an embodiment with obliquely set ribs providing security against rotation which extend in the radial direction across the ring recess and in the axial direction along the undercut of the piercing section, FIGS. 10A-10D representations corresponding to FIGS. 8A-8D, but of an embodiment with angled ribs providing security against rotation which extend in a radial direction across the ring recess and in the axial direction along the undercut of the piercing section, FIGS. 11A-11D representations in accordance with FIGS. 8A-8D, but of an embodiment with features providing security against rotation which are formed by grooves or recesses, and FIGS. 12A-12D representations corresponding to FIGS. 8A-8D but of an embodiment with a polygonal ring shape in plan view, of square shape in the specific case.

FIG. 1 shows a portion of an elongate section 1 with a rectangular cross-section, a first broad side 2, a second broad side 3 and two narrow sides 7, 8. The longitudinal edges 9 of the section can be rounded as shown. It can, however, also have another shape, for example a chamfer or a rectangular shape. The section is processed in a progressive tool in order to manufacture hollow elements, for example nut elements with an essentially rectangular or square shape. When the, hollow elements are to be realized as nut elements a thread must be cut or produced in the hole of the hollow body element. This normally takes place outside of the progressive tool in a separate machine. Furthermore, the possibility exists of only manufacturing the thread after the attachment of the hollow body element to a sheet metal part, for example by means of a thread forming or thread cutting screw. Furthermore, it is not necessary to provide a thread in the hollow body element, but rather the hole of the hollow body element could serve as a smooth bore for the rotational journaling of a shaft or as a plug mount to receive a plug-in pin.

Figure 2:
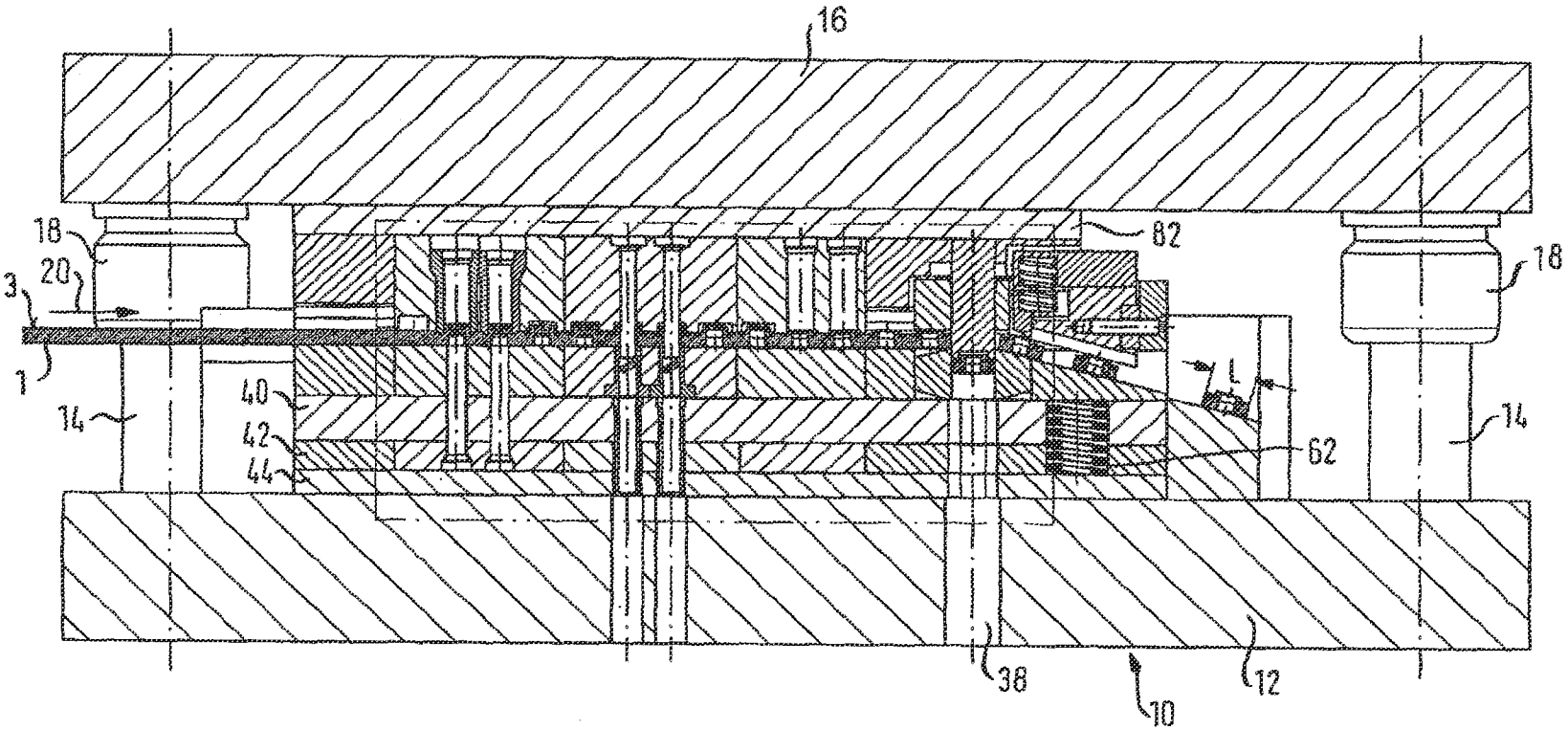

A first progressive tool 10 which serves for the manufacture of the hollow body elements from the section 21 of FIG. 1 or from a similar section is shown in FIG. 2 in longitudinal section, with the longitudinal section being taken through the centre of the section.

One can see from FIG. 2 a lower plate 12 which is normally secured to a press table either directly or indirectly via an intermediate plate, not shown. The lower plate 12 carries a plurality of columns 14, four in this example, of which two can be seen, namely the two columns which lie be-hind the section plane. A further plate 16 is present above the columns and is normally secured to the upper tool plate of the press or to an intermediate plate of the press. Guides 18 are screwed to the plate 16 (for example by means of screws which are not shown here) with the guides 18 being designed in order to slide up and down on the columns 14 in accordance with the stroke movement of the press. The section 1 is advanced in the arrow direction 20 for each stroke of the press and indeed by an amount which corresponds to twice the longitudinal dimension L of the individual hollow body elements manufactured from the section. One notes that in the representation in accordance with FIGS. 2 and 3 the section 1 is guided through the progressive tool with the second broad side 3 directed upwardly. As can be seen from the enlarged representation of the central region of the progressive tool of FIG. 3, the progressive tool includes in this example four working stations A, B, C, D in each of which two respective operations are simultaneously effected for each stroke of the press.

In the first station A a so-called upsetting process takes place as a first step a).

Figure 3:
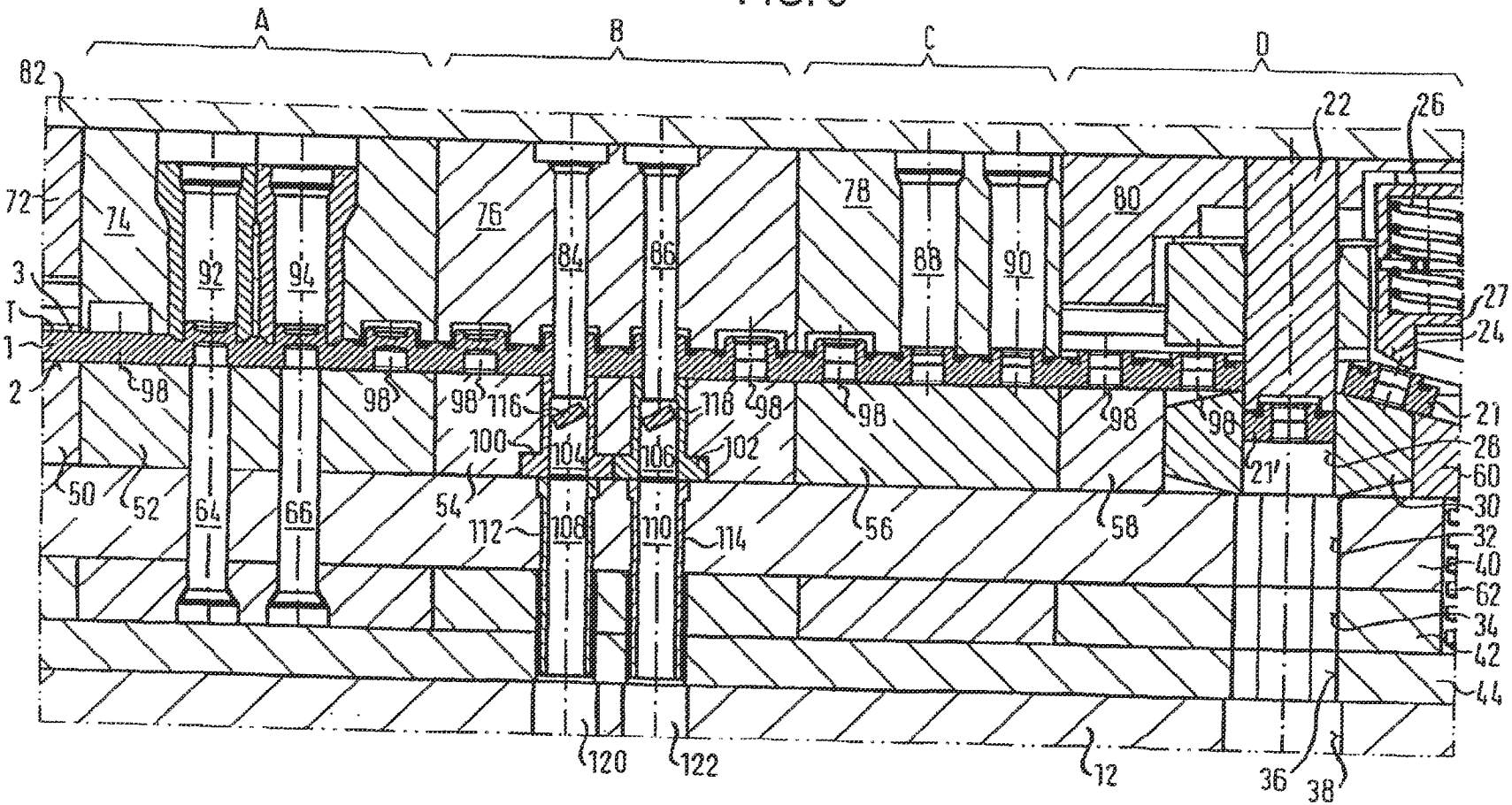

In the second working station B, a piercing process is carried out in a second step b) and a crushing or flattening process is carried out in the third working station C in a third step c). Finally, a cut-off punch 22 is used in the fourth working station D in order to separate two hollow body elements from the section 1 for each stroke of the press. In doing this, the right hand side of the punch cuts through the section at a partitioning point which is located behind the first hollow body element, i.e. the hollow body element 21 in FIG. 3 and also at a cutting point behind the second hollow body element 21'. The progressive tool is shown in FIGS. 2 and 3 in the closed position in which the two hollow body elements 21 and 21' have just been cut from the section 1. Shortly before the cut-off process, the front side of the nut element 21 contacts the inclined surface 24 of the right angled cam 27 which is pressed downwardly by a compression coil spring 26. The advance of the strip of the section thus presses the cam 24 upwardly via its inclined surface, whereby the spring 26 is compressed. After the first hollow body element 21 has been cut off, the cam 24 presses on the right hand side of the nut element 21 and tips it into the inclined position which is evident at the right hand side of FIG. 3. The nut element 21 then falls on a slide out of the working range of the progressive tool and can, for example, then be led sidewise out of the progressive tool in accordance with FIG. 2, for example via a lateral slide under the effect of gravity or with a burst of compressed air, etc.

The second hollow body element 21' falls through a hole 28 in the cut-off die 30 and subsequently through corresponding bores 32, 34, 36 and 38 which are formed in the plates 40, 42, 44 and 12.

The bores or the hole 38 in the plate 12 can lead with a further bore (not shown) in the press table or in any intermediate plate that is provided between the plate 12 and the press table which enables the nut elements such as 21' to be led out, for example under the action of gravity or also via a lateral slide or using a burst of compressed air.

In the specific construction shown in FIG. 3, the plate 44 is screwed via non-illustrated screws to the plate 12. The plate 42 consists of a plurality of plate sections which are associated with the respective working stations and which are screwed via further non-illustrated screws (because they are arranged outside of the plane of the sectional representation) to the through-going plate 44. The through-going plate 40 is likewise screwed to the sections of the plate 42, and indeed also here by means of non-illustrated screws. Above the through-going plate 40, there are in turn plate sections 50, 52, 54, 56, 58 and 60 which are in turn screwed to the plate 40. The plate 50 is a support plate which forms a lower guide for the section 1, stated more precisely for the first broad side 2 of the section 1 which, in this representation, forms the lower side. The plate sections 52, 54 and 56 are associated with the working stations A, B and C, whereas the plate sections 58 and 60, which form a receiver for the cut-off die 30, are associated with the working station D.

Powerful compression coil springs 62 of which only the one spring can be seen in FIGS. 2 and 3, because the others are located outside of the section plane, are located at a plurality of positions between the through-going plate 44 and the plate sections 50, 52, 54, 56, 58 and 60. These springs such as 62 have the function of lifting the plate sections 50 to 60 on the opening of the press, whereby the strip of section 1 is also lifted and hereby moves out of the working range of the upsetting punches 64, 66, whereby the section can be further advanced by twice the amount of the length L of the hollow body elements 21.

The partition plane of the progressive tool is located above the section 1 and is designated with T in FIG. 3.

Above the strip of the section, there are in turn located plate sections 72, 74, 76, 78 and 80 which are screwed to a through-going plate 82—also here via non-illustrated screws. Furthermore, the plate 82 is screwed to the upper plate 16.

On the opening of the press, the plates 72, 74, 76, 78 and 80 are thus lifted with the plate 22 and the upper plate 16, and indeed so far that the two hole punches 84, 86 and the two upper flattening punches 88 and 90 as well as the dies 92 and 94, which cooperate with the upsetting punches 64, 66, and also the cut-off punch 22 move out of engagement with the strip of the section 1. Through this movement, coupled with the lifting of the strip of the section by the spring 62, it is made possible for the strip of the section 1 to be able to be further advanced by twice the length dimension of the hollow body elements 21 in preparation for the next stroke of the press.

One sees that the working stations A and B have a longitudinal dimension, i.e. in the direction 20 of the strip of the section 1 which corresponds to four times the length dimension of the hollow body element 21. The working station C has a length dimension which corresponds to three times the length dimension of the hollow body element 21 whereas the working station D has a length dimension which corresponds to a multiple of the length dimension of the hollow body element 21, in this example six times as much. This signifies that so-called empty positions such as 98 are present at which no processing of the strip of the section 1 takes place. These empty positions, however, provide space which is necessary in order to be able to make the individual components of the tools that are used sufficiently stable and to support them.

Furthermore, one can see from FIG. 3 that the piercing dies 100, 102, which cooperate with the piercing punches 84, 86 have a central bore 104 and 106 respectively, which are aligned with further bores 108, 110 in insert sleeves 112, 114 which enable the punched out slugs 116, 118 to be disposed of. These namely fall downwardly through the bores 108, 114 which are larger in diameter than the bores 104, 106 and through the further bores 120, 122 in the plate 12 and can be disposed off or led away via corresponding passages in the press table or in an intermediate plate which may be provided in the same way and means as the nut elements 21.

Although not shown here, guide elements are located to the left and right of the strip of the section 1, i.e. behind the plane of the drawing and in front of the plane of the drawing of FIG. 3 and can for example be formed by cheeks of the plates 50, 52, 54, 56 and 58, which ensure that the strip of the section follows the desired path of movement through the progressive tool. A small lateral free space can be provided which permits any expansion of the strip of the section which may occur in the transverse direction.

The design details of the upsetting punches 64, 66 of the die buttons 92, 94 which cooperate with them, of the hole punches 84, 86, of the die buttons 100, 102 which cooperate with them and of the flattening punch 88, 90 can be seen from the drawings of FIGS. 2 and 3 and will in other respects be explained more precisely in the following drawings.

By means of the progressive tools of FIGS. 2 and 3 a method is realized for the manufacture of hollow body elements such as nut elements for attachment to components which usually consist of sheet metal. The method serves for the manufacture of hollow body elements 21, 21', for example with an at least substantially square or rectangular outline, by cutting individual elements to length from a section 1 present in the form of a sectional bar or of a coil after the prior punching of holes 23 into the section 1, optionally with subsequent formation of a thread cylinder using a progressive tool with a plurality of working stations A, B, C, D in which respective operations are carried out. The method is characterized in that in each case two operations are simultaneously carried out for each stroke of the progressive tool in each working station A, B, C, D for the section 1 or for a plurality of sections arranged alongside one another. I.e. it is basically possible to process a plurality of sections 1 alongside one another and at the same time in the same progressive tool, assuming that the corresponding number of individual tools such as upsetting punches, hole punches and associated die buttons is present.

In the last working station, two hollow body elements 21, 21' are in each case cut from the section or from each section 1 by means of a cut-off punch 22.

The cut-off punch 22 cuts through the section at a first point behind a first hollow body element 21 and at a second point behind a second hollow body element 21', with the second hollow body element 21' being guided out of the path of movement of the section in the direction of movement of the cut-off punch transversely to the longitudinal direction of the section 1. The first hollow body element 21 is led out in the cut-off station of the progressive tool at least initially in general in the direction of the path of movement of the section.

Each working station of the progressive tool has a length in the longitudinal direction of the section which corresponds to three times or four times or to a multiple of the longitudinal dimension of a finished hollow body element 21, 21'.

In the embodiment of the progressive tool shown, a spring loaded cam 27 having a cam surface 24 set obliquely to the path of movement of the section is biased by the front edge of the front end of the section at the outlet end of the last working station against the force of the spring device 26. After cutting off the hollow body element 21 formed at the front end of the section it is tilted downwardly by the spring-loaded cam in order to facilitate the removal from the progressive tool.

In the embodiment of FIGS. 2 and 3, the lower stamps 64, 66 operate to carry out the upsetting process and the hole punches 84, 86 to carry out the piercing process from opposite sides of the section 1 on the latter. When carrying out the flattening process, the respective flattening stamps 88, 90 act from above on the strip of the section 1 while the strip is sup-ported in the region of a piercing by a plate section 56. Instead of this, it would also be possible to arrange support pins at the plate section 56 at the points of the holes in the strip of the section if it appears necessary to support the section material in this region during the flattening process, for example in order to achieve a more sharp edged design of the end face of the hollow piercing section.

Some examples will now be given which describe the manufacture of the specific hollow body elements.

Figure 4A:
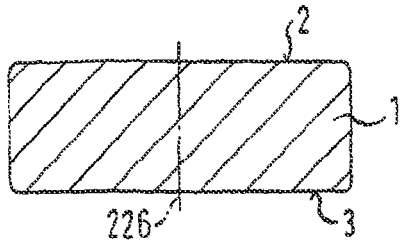
Figure 4B:
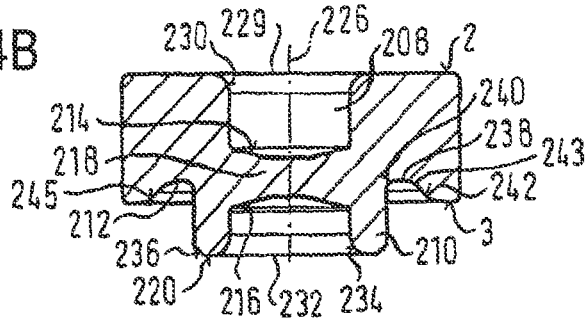
Figure 4C:
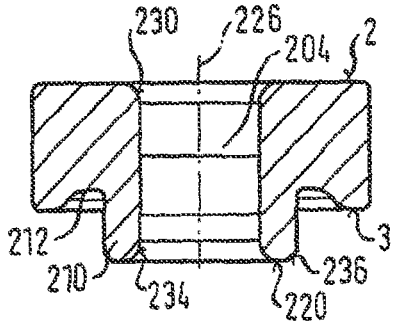
Figure 4D:
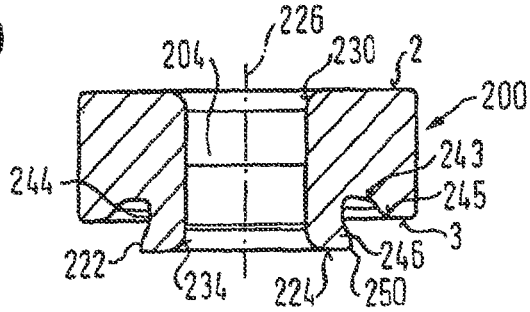
Figure 4E:
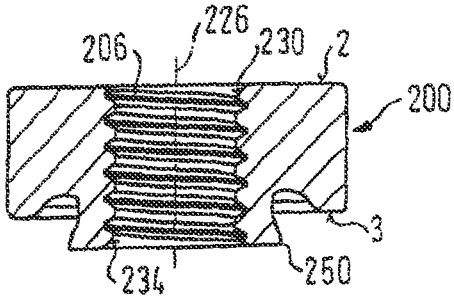

Referring to FIGS. 4A-4E and FIGS. 5A-5D, the method of the invention for the manufacture of hollow body elements such as nut elements will now be described which are designed for attachment to components which normally consist of sheet metal. One is concerned here in particular with a method for the manufacture of hollow body elements 200 having an at least substantially square or rectangular outline 202 by cutting individual elements to length from a section present in the form of a sectional bar (1, FIG. 1) or a coil after the prior stamping of holes 204 in the section, optionally with subsequent formation of a thread cylinder 206 using a progressive tool (FIG. 2, FIG. 3) having a plurality of working stations A, B, C and D, in which respective operations are carried out. The method is characterized by the following steps:

a) In a first step, starting from a section 1, FIG. 4A which is rectangular in cross-section, an upsetting process is carried out using upsetting die buttons 92, 94 which come from the top and the upsetting punches 64, 66. The upsetting process leads to a cylindrical recess 208 at a first broad side 2 of the section 1 and to a hollow cylindrical projection 210 at a second broad side 3 of the section lying opposite to the first broad side 2, with the projection being surrounded by a ring-like recess 212 which is shown in FIG. 4B. The strip of the section 1 is pressed during closing of the press, i.e. of the progressive tool, onto the ends of the upsetting punches 64 and 66 projecting above the plate section 52. The projecting ends of the upsetting punches have a shape complementary to the shape of the cylindrical recess 208 which is shown in FIG. 4B. In similar manner, the end faces of the die buttons 92, 94 cooperating with the upsetting punches have a shape complementary to that of the hollow cylindrical projection 210 and to the ring recess 212 surrounding it in accordance with FIG. 4B.

b) In a second step, a web 218 which remains between the base 214 of the cylindrical recess 208 and the base 216 of the hollow cylindrical projection 210 is pierced on the closing of the press, i.e. of the progressive tool 10, by means of the hole punch 88, 90 to form the through-going hole 204 (FIG. 4C). The punched-out slugs are disposed of as mentioned via the bores 104, 106 and 108, 110 respectively.

c) In a third step, the hollow cylindrical projection 210 is flattened at its free end face 220 to form a piercing section 222 undercut on the outer side, whereby the end face 224 in FIG. 4D is formed which stands in a plane parallel to the broad sides 2 and 3 and perpendicular to the central longitudinal axis 226 of the hole 204. Thereafter, the hollow body elements can be separated from the section in the working station D and subsequently be provided with a thread 206 if required, as shown in FIG. 4E or in the identical FIG. 5C.

The third step could, if required, be combined with the step b).

During the upsetting process of the step a), the diameter of the cylindrical recess and the inner diameter of the hollow cylindrical projection are made at least substantially the same.

Furthermore, the opening 229 of the cylindrical recess 208 at the first broad side 2 of the section is provided with a rounded or chamfered run-in edge 230 which forms the thread run-out when using the element, preferably during the upsetting process of step a) or during the piercing process of step b) or during the flattening process of step c).

During the upsetting process of step a) or during the piercing process of step b) or during the flattening process of step c), the mouth 232 of the hollow cylindrical projection 210 is preferably also provided with a rounded or chamfered run-out edge 234 which forms the thread run-in in the finished element.

During the piercing of the web in accordance with step b,) the hole 204 is produced with a diameter which at least substantially corresponds to the diameter of the cylindrical recess 208 and to the inner diameter of the hollow cylindrical projection 210. Furthermore, during the upsetting process of the first step a), the free end of the hollow cylindrical projection 210 is provided at the outside with a chamfer 236. Moreover, during this upset-ting process, the ring recess 212 is provided with a ring-like base region 238 which stands at least approximately in a plane parallel to the first and second broad sides 2, 3 of the strip of the section and merges at the radially inner side with an at least substantially rounded transition 240 into the outer side of the hollow cylindrical projection 210 and merges at the radially outer side into a conical surface 242 which forms an included cone angle in the range between 60 to 120°, preferably of about 90°.

The transition 243 from the ring-like region 238 of the ring recess 212 into the conical surface 242 is rounded as is also the run-out 245 of the conical surface of the ring recess 212 into the second broad side 3 of the section. The conical surface 242 can present itself in practice such that the rounded transition 243 merges tangentially into the rounded run-out 245.

During the manufacture of the undercut 244, the latter is formed by a cylindrical part of the hollow cylindrical projection 210 which merges approximately at the level of the second broad side 3 of the section 1 into a region 246 of the hollow cylindrical projection 210 which is thickened during the carrying out of the step c) and which at least substantially projects beyond the second broad side 3 of the section.

The thickened region 246 of the hollow cylindrical projection 210 is made at least substantially conical and diverges away from the first and second broad sides, with the cone angle of the thickened region of the hollow cylindrical projection adjacent to the end face 224 lying in the range between 30° and 70°, preferably at about 50°. After the flattening process, the hollow cylindrical projection 219 terminates at its free end at the outside in a piercing edge 250 which is made as sharp edged as possible.

Figure 5A:
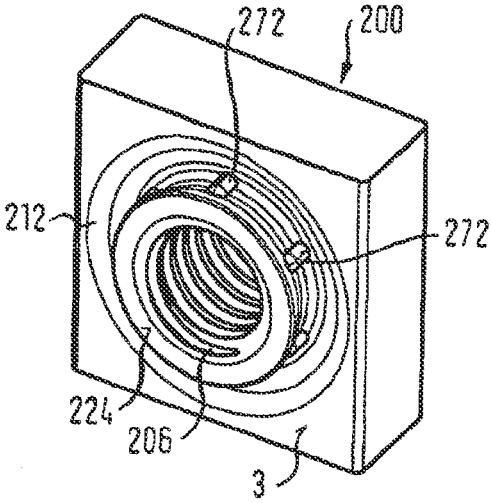
Figure 5B:
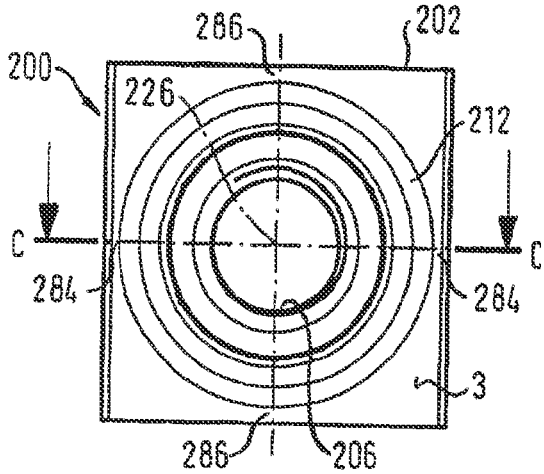
Figure 5C:
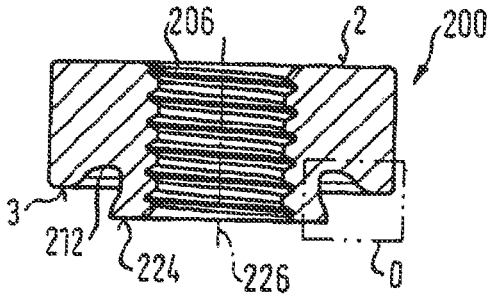

As can be seen from FIGS. 5A and 5B in particular, the ring recess is executed with an outer diameter which is only somewhat smaller than the smallest transverse dimension of the hollow body element which is rectangular in plan view, whereby the ring recess 212 forms, with the second broad side 3 at the section 1, webs 284, 286 in the range from 0.25 to 1 mm, preferably of about 0.5 mm which remain at the narrowest points in the plane of the second broad side 3.

The FIGS. 5E-5I and 5J-5N show essentially the same elements as in the FIGS. 5A-5D but with small differences with respect to the design of the piercing section 222 which has an ideal shape in the two versions according to FIGS. 5E-5I and 5J-5N.

In the FIGS. 5E-5I and 5J-5N the same reference numerals have been used as were also used in conjunction with the previous embodiments. It will be understood that the previous description also applies to the FIGS. 5E-5I and 5J-5N, i.e. that the previous description of features with the same reference numerals also applies to the description of the FIGS. 5E-5I and 5J-5N. This convention is also retained in the further Figures so that only important differences or significant features will be especially described here.

The main difference between the embodiments of FIGS. 5E-5I and the embodiment of FIGS. 5J-5N lies in the fact that the embodiment of FIGS. 5E-5I is used for thicker sheet metal in the range of, for example, 1.2 to 2.0 mm sheet metal thickness whereas the embodiment of FIGS. 5J-5N is used for somewhat thinner sheet metal, for example in the range of 0.4 to 1.2 mm sheet metal thickness.

Specifically, FIG. 5E shows a view from below onto the lower end face of the piercing section 222, i.e. in the arrow direction E of FIG. 5H. The FIG. 5F is a sectional drawing corresponding to the vertical section plane F-F in FIG. 5E, so that in FIG. 5F the two ribs 272 providing security against rotation which extends in the axial direction and which are located at the 12 o'clock and the 6 o'clock positions in FIG. 5E can each be seen in section. In contrast four further ribs 272' providing security against rotation which are entered into FIG. 5E can be seen neither in FIG. 5F nor in FIG. 5G which shows a section drawing in accordance with the section plane G-G.

They can also only be recognized by way of indication in FIG. 5E because they are in principle largely hidden behind the piercing section 222. They are not evident in the sectional drawing of FIG. 5 because the section plane is selected such that the ribs 272 or 272' providing security against rotation do not lie in the plane of the section or adjacent the plane of the section and are also not sufficiently large that they could be recognized in side view in the section plane.

The FIGS. 5H and 5I each show an enlarged representation of the regions shown in a chain-dotted rectangle in FIGS. 5G or 5F respectively. It can be seen from FIGS. 5H to 5I that the lower end face 224 of the piercing section 222 is formed by a radius in the section plane which runs out tangentially at the cutting edge 250.

This represents a distinction to the end face 224 of the embodiment of FIGS. 5A-5D which has a significant ring surface component in a plane perpendicular to the central longitudinal axis 226 of the hollow body element.

Figure 5D:
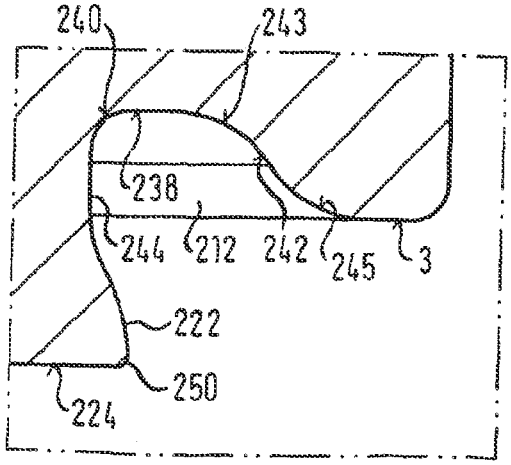
Figure 6A:
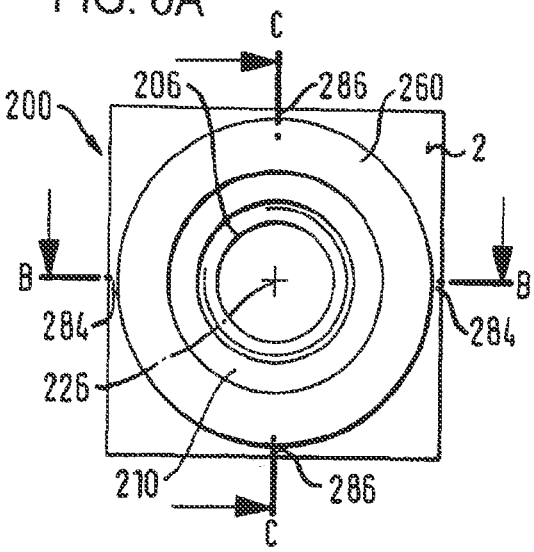
Figure 6C:
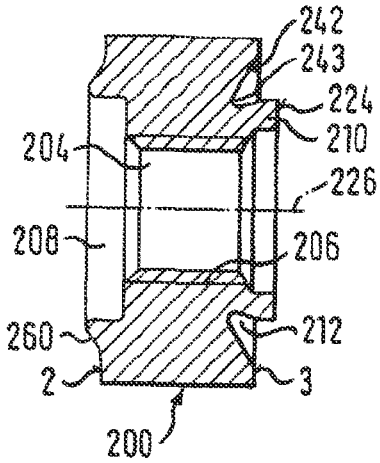
Figure 6B:
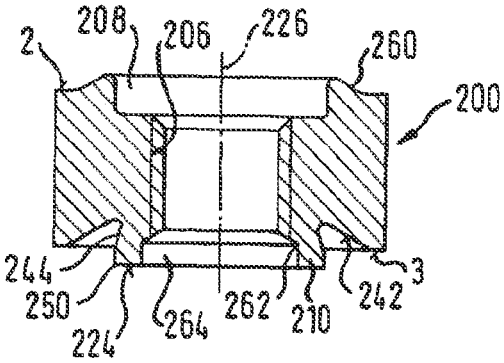
Figure 6E:
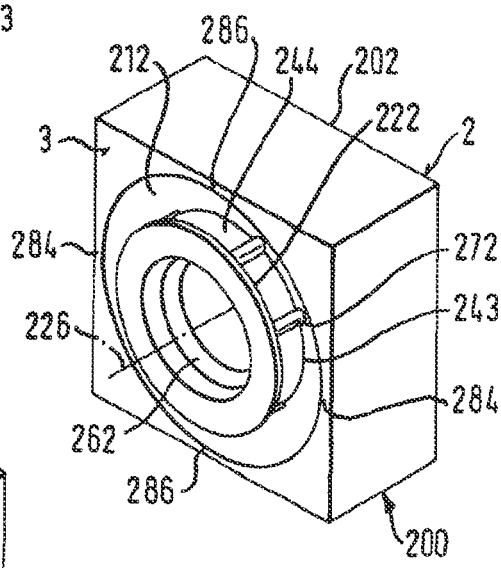
Figure 6D:
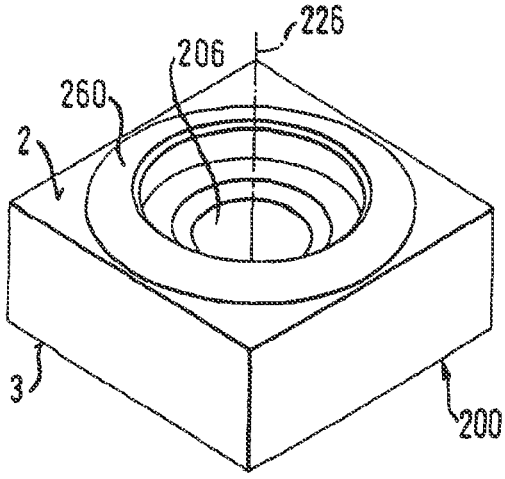

Furthermore it can in particular be recognized from the drawings of FIGS. 5H and 5I that the region of the ring recess 212 designated as a conical inclined surface 242 in FIG. 5D is actually formed by two radii which merge into one another at a turning point. In this example, with only a very short straight portion which is indicated by the two lines 301 and 303 and which in practice also does not have to be present, i.e. the two radii which form the obliquely set wall of the recess (curved regions 243 and 245) can merge directly into one another tangentially. Nevertheless, in the region of the turning point a surface region is present which can be termed approximately flat so that the designation "at least substantially conical" is justified. Naturally, a clearer strictly conical region could also be provided.

Through the use of the same reference numerals it can be seen that the FIGS. 5J-5N are to be understood in precisely the same way as the FIGS. 5E-5I. The only difference here is that the noses 272' providing security against rotation in FIG. 5E cannot be seen in FIG. 5J, and indeed because they are actually hidden behind the ring-like piercing edge 250. Thus, the noses 272 providing security against rotation can only be seen in FIG. 5K and in FIG. 5N.

In an alternative method which leads to the hollow body element in accordance with FIGS. 6A to 6E, a ring-like raised portion 260 is formed around the cylindrical recess 208 during the upsetting process in accordance with step a) by the use of correspondingly shaped upsetting punches 64, 66 and upsetting die buttons 92, 94 at the first broad side 2 of the section, the raised portion for example essentially representing a material volume which corresponds to the volume of the ring recess 212 around the hollow cylindrical projection. In this embodiment, the diameter of the cylindrical recess 208 is larger than the internal diameter of the hollow cylindrical projection 210. Furthermore the thread 206 terminates in a conical region 262 of a stepped hole 264 which, in this example, can be optionally used instead of a rounded thread run-out (which would also be possible in the embodiment of FIGS. 4A to 4C or FIGS. 5A to 5D respectively).

The base of the ring recess is, in this embodiment, formed solely by a rounded transition 243 from the hollow cylindrical projection 210 into the conical surface 242, which would also be possible in the embodiment of FIGS. 4A to 4E and FIGS. 5A to 5D respectively.

During the upsetting process in accordance with step a), features 272 providing security against rotation are formed by corresponding profiling of the upsetting punches 92, 94 outwardly at the hollow cylindrical projection 210 and internally in the region of the ring recess 212 around the hollow cylindrical projection 210.

These features providing security against rotation can (as shown) be formed by ribs 272 and/or by grooves (not shown) at the radially outer side of the hollow cylindrical projection 210. These ribs 272 extend in the axial direction 226 and bridge the undercut 244 of the hollow cylindrical projection 210. They have a radial width which corresponds at least substantially to an amount in the range between 40% and 90% of the maxi-mal radial depth of the undercut.

Thus, a hollow body element 200 arises for attachment to a component 280 which normally consists of sheet metal (FIGS. 7A and 7B respectively) with an at least substantially square or rectangular outline 202 with a first broad side 2 and a second broad side 3 and with a piercing section 246 which projects beyond the second broad side and has an undercut and is surrounded by a ring recess 212 in the second broad side as well as with an hole 204 which extends from the first broad side 2 through the piercing section 246, with the hole optionally having a thread cylinder 206 and with the hollow body element being characterized in that features 272 providing security against rotation are formed outwardly on the hollow cylindrical projection 210 and/or inwardly in the region of the ring recess 212 around the hollow cylindrical projection 210.

The hollow body element is further characterized in that the second broad side 3 lies radially outside of the ring recess 212 in one plane, i.e. apart from any rounded features or chamfers at the transitions into the side flanks of the hollow body element and thus no bars, grooves or undercuts are present in the region outside of the ring recess.

The ring recess 212 is executed with an outer diameter which is only slightly smaller than the smallest transverse dimension of the hollow body element which is rectangular in cross-section in plan view, whereby the ring recess forms webs in the range from 0.25 to 1 mm and preferably of about 0.5 mm with the second broad side 3 of the section which remain at the narrowest points 284, 286 in the plane of the second broad side.

Figure 7A:
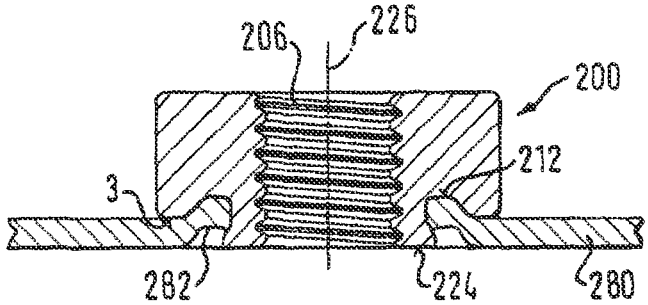
Figure 7B:
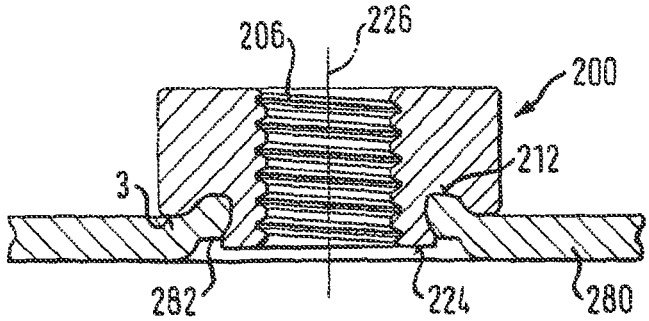
Figure 14A:
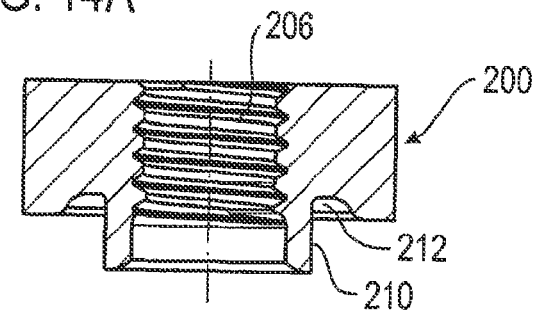
Figure 14B:
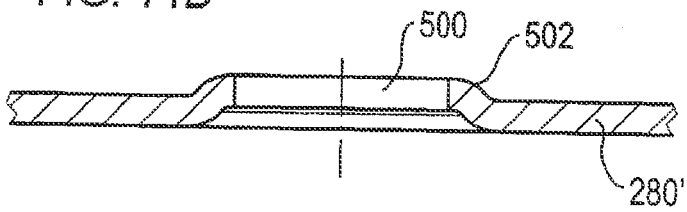
Figure 14C:
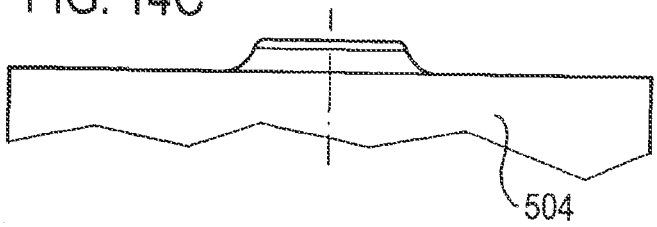
Figure 14D:
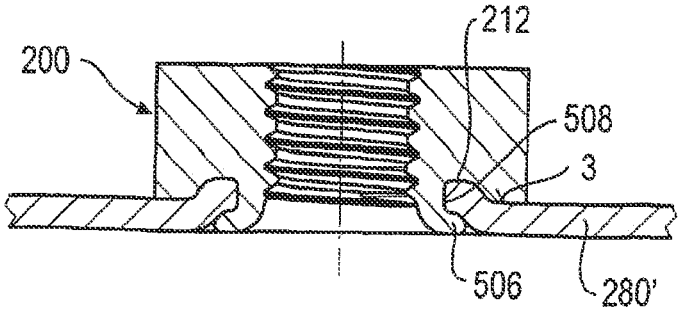

The FIGS. 7A and 7B show how one and the same element 200 in accordance with the invention can be used in accordance with FIGS. 5A to 5D with a thinner sheet metal part (FIG. 7A) of, for example, 0.7 mm thickness and with a thicker sheet metal part (FIG. 7B) of for example 1.85 mm thickness. The sheet metal material fills out the entire ring recess 212 after the pressing by means of a die button and lies in contact with the full surface of the ring recess and of the features 272 providing security against rotation in the region of the undercut. Thus, in both cases, a good overlap with the ribs 272 providing security against rotation exists and thus a good security against rotation between the hollow body element 200 and the sheet metal part 280. The piercing section 246 is at least not essentially deformed in these examples and is introduced in self-piercing manner into the sheet metal part. The flattened end face 224 of the piercing section 246 lies with thin metal sheets (as shown in FIG. 7A) at the level of the lower side of the sheet metal part and with thicker sheet metal parts (FIG. 7B) above the lower side of the sheet metal part (i.e. the side of the sheet metal part remote from the body part of the hollow body element). In both cases, a ring recess 282 is present around the piercing section which has a form given by the specific shape of the complementary designed die button during the self-piercing attachment of the hollow body element in a press or through a robot or in a C-frame. In this connection, the die button has, as is usual in the self-piercing attachment of fastener elements, a central bore through which the punched-out slugs which arise are disposed of. Although the hollow body elements in accordance with the invention are made self-piercing, they can nevertheless be used in pre-pierced sheet metal parts. In a second embodiment of the hollow body element in accordance with the invention, a further range of thicknesses of sheet metal parts can be covered, for example 1.85 to 3 mm. It is simply necessary to make the piercing section somewhat longer.

As the hollow body elements which are square in plan view are attached in such a way that the second broad side 3 directly contacts the upper side of the sheet metal part 280, but does not or essentially does not dig into the sheet metal part, a notch action need not be feared so that a good fatigue behavior results thanks to a good fatigue resistance even under dynamic loads. Although the hollow body elements are square in plan view no special orientation of the die button relative to the respectively used setting head is necessary because the piercing section is circular in plan view and thus orientation-free. It is only necessary to ensure that the setting head and the die button lie coaxial to one another and to the longitudinal axis 226 of the hollow body element. During attachment of a further component to a component assembly in accordance with FIGS. 7A or 7B, the further component is normally secured to the sheet metal part at the bottom by a screw (not shown) which is screwed, coming from the bottom into the thread. In this way, the connection between the hollow body element 200 and the sheet metal part is increased through tightening of the screw.

Furthermore, it should be pointed out that ribs providing security against rotation would be conceivable which cross or bridge the ring recess 212 in the radial direction as for example shown in FIGS. 8A-8D, FIGS. 9A-9D or FIGS. 10A-10D. Such ribs providing security against rotation could lie flush with the broad side 3 (FIGS. 8A-8D) or could be present recessed within the ring recess (such features providing security against rotation are not shown in the drawings).

In the embodiment of FIGS. 8A-8D the free top sides of the ribs providing security against rotation, which are indicated with 272" lie in the same plane as the surface of the broad side 3 outside of the ring recess 272. The sides 272" can, however, also be arranged set back from the broad side 3. Since the ribs providing security against rotation bridge the ring recess 212, they are also to be found at the side of the ring-like piercing section 222 in the region of the under-cut 244.

The FIGS. 9A-9C show a further variant in which the features providing security against rotation have the shape of ribs providing security against rotation which extend in the radial direction over the ring recess 212, but the upper sides 272'" of the ribs 272 providing security against rotation of the embodiment in accordance with FIGS. 9A-9D are set obliquely so that they rise going in the direction towards the piercing section 222 and thus not only extend in the radial direction over the ring recess and bridge it, but rather also extend in the axial direction at the under-cut 244 of the piercing section 222 over a considerable length or over the full length in the undercut 244.

The FIGS. 10A-10D shown an embodiment which is very similar to that of the FIGS. 9A-9D, but here the ribs providing security against rotation are angled so that they have a radial component 272"" and an axial component 272"" which merge into one another via a radius 272"" and thus generally have the described angled shape.

FIGS. 11A-11D show another kind of features providing security against rotation, here in the form of recesses 272"""" or grooves which are formed in the obliquely set side wall of the ring recess 212, with the recesses 272"""" having an approximately shell-like shape in plan view here. Other shapes of the recesses are also conceivable, for example elongated grooves which are made narrower in the region of the broad side 3.

Finally, the FIGS. 12A-12D show a somewhat different form of a hollow body element in accordance with the invention. The important distinction in the shape of the hollow body element in the embodiment in accordance with FIGS. 12A-12D is to be seen in the fact that the ring recess has a polygonal shape 212' here, and indeed in the specific case a square shape in plan view, with the ring recess having a corresponding number, i.e. four, obliquely inclined surfaces 400, 402, 404 and 406 which merge into one another by means of radii 408, 410, 412 and 414. At the lowest point of the ring recess 212' which is polygonal in plan view there is an areal region which is defined by four corner regions 416, 418, 420 and 422 and is arranged in a plane perpendicular to the central longitudinal axis 226 of the element. The piercing section 222 merges via a radius 424 into these corner regions, with the radius having a diameter at the radially outermost point which is fractionally larger than the maximal transverse dimension of the areal region formed by the four corners 416, 418, 420 and 422 so that this radius ultimately merges into the lowest side of the four obliquely set surfaces. All thin parallel lines such as 426, 426' and 426" show radii or rounded surfaces which ensure amongst other things a gentle bending of the sheet metal part.

In this embodiment, it is not necessary to provide separate ribs providing security against rotation because the polygonal shape of the ring recess 212' itself takes care of the required security against rotation. This embodiment is also advantageous because the obliquely set surfaces and also the corner regions in the base region of the ring recess belong to the con-tact surface of the element so that it is possible to operate with correspondingly low surface pressures at the sheet metal part and the danger of settling of the element does not exist. Nevertheless, high values for the security against rotation can be achieved as well as a high pull-out resistance.

The rounded regions between the obliquely set surfaces also have the ad-vantage that no pronounced sharp features are present at these points in the sheet metal part which could lead to fatigue in particular with dynamic loading of the component. Because the piercing section 222 produces a circular hole in the sheet metal part, as in other embodiments, stress concentrations are also not to be expected here which could lead to fatigue cracks in operation. During the attachment of the hollow body element to the sheet metal part, the element is at least substantially not deformed, a deformation is undesired and the sheet metal part is brought by a suitable complementary shape of the die button into the square recess 212' in the region around the piercing section 222 and fully into con-tact with this piercing section around the piercing section.

In all embodiments of FIGS. 8A-8D to FIGS. 12A-12D, the hollow body element is made flat at the first broad side 2, i.e. with an end face which lies perpendicular to the central longitudinal axis 226 of the element in accordance with the previous embodiment of FIGS. 5A-5N. It is, however, entirely conceivable that the corresponding end face in the embodiments of FIGS. 8A-8D to FIGS. 12A-12D could be made similar to the embodiment of FIG. 6D. In the FIGS. 12A-12D this signifies that, instead of a circular ring shaped raised portion as in FIG. 6D, the raised portion will then have a corresponding polygonal shape, here a square shape.

When the talk in this application is of a polygonal shape this also includes in any case polygons with three to twelve polygonal surfaces i.e. obliquely set surfaces.

In the embodiment of FIGS. 12A-12D as shown, a considerable material displacement takes place in the region of the recess which is square in plan view, so that it is here entirely possible for the hollow cylindrical projection which is transformed by the flattening into the piercing section 222 to be achieved solely by material displacement from the second broad side 3 of the hollow body element, i.e. it is not necessary to carry out an upsetting process in the first step of the manufacturing method in which material is displaced from a first broad side 2. I.e. the first manufacturing step a) in accordance with claim 1 can be replaced here by a forming process in which the hollow cylindrical projection 210 is formed solely by material displacement out of the region of the ring recess which is polygonal in plan view and in the region of the hollow space of the hollow cylindrical projection 210. During the subsequent piercing process the body formed in this way is then pierced starting from the first broad side 2 and up to the base 216 of the hollow space 232.

The design of the ring recess 212 does not necessarily have to take place at the same time as the upsetting process, but could rather be combined with the piercing process or with the flattening process, i.e. the piercing punches 84, 86 or the flattening punches 88, 90 must in this case have a corresponding shape.

It is not necessary to separate the hollow body elements from one another in the progressive tool, but rather the section can be retained or used after manufacture of the general shape of the hollow body elements in sections or in re-coiled shape, with a separation into individual hollow body elements then only taking place when the section is used in a setting head for the attachment of the hollow body elements to a component.

The methods, hollow body elements, component assemblies, progressive tools and rolling mechanisms of the invention will now be described which arise through a modification of a simplification of the methods, hollow body elements, component assemblies and progressive tools previously described in conjunction with the FIGS. 1 to 12. In order to facilitate the description of the invention in accordance with FIGS. 13 to 27 the same reference numerals are used as were used in connection with the embodiments in accordance with FIGS. 1 to 12. It will be understood that the previous description also applies for the FIGS. 13 to 27, i.e. that the earlier description of features with the same reference numerals also applies for the description of the FIGS. 13 to 27 so that it is only necessary to describe the important differences. Accordingly, only important differences of significant features will be especially described here.

Referring to the FIGS. 13A to 13D a hollow body element is shown there which corresponds to the element in accordance with FIGS. 5A to 5D apart from the fact that the pilot part, i.e. the hollow projection 210 is here designed without undercut. Consequently the axial ribs 272 providing security against rotation can be recognized better because they are not hidden in an undercut but rather project in the radial direction away from the projection 210 which is here of hollow cylindrical shape. Furthermore, it is evident that the thread in the hollow body elements in accordance with the invention terminates directly before the hollow cylindrical projection, i.e. it does not project into the hollow cylindrical projection because it would otherwise be deformed on reforming the hollow cylindrical projection or rivet section 210, which would make the introduction of a bolt more difficult or impossible.

Although the hollow body element in accordance with the invention has only been described in conjunction with a modification of the embodiment of the FIGS. 5A to 5D all the previously described embodiments of hollow body elements, i.e. amongst other things the hollow body elements of the FIGS. 5E to 5N, of FIGS. 6A to 6E, of FIGS. 8A to 8D, of FIGS. 9A to 9D, of FIGS. 10A to 10D, of FIGS. 11A to 11D and of FIGS. 12A to 12D can be made into hollow body elements in accordance with the invention in that the undercut of the hollow projection 210 is omitted so that a cylindrical projection results as shown in the FIGS. 13A to 13D, but with the designs of the respective features providing security against rotation of the named Figures.

The question arises as to how such hollow body elements can then be attached to a sheet metal part so that they are secure against press-out, push-out and lever-out and whether they can be used in self-piercing manner. The answer to the first question is that the respective hollow body elements are now formed as rivet elements and indeed such that the hollow cylindrical projection is beaded over, after the introduction of the projection through a hole in the sheet metal part, to form a rivet bead. The way this can be done is shown with reference to a pre-pierced sheet metal part 280' in FIG. 14B, where the hole 500 is provided in the base region of a bead 502. This is a pre-pierced sheet metal part. After the introduction of the hollow cylindrical projection through the hole 500 in the sheet metal part, the hollow cylindrical projection, which forms the rivet section, is beaded over by means of the rivet die 504 to form a rivet bead 506 which clampingly receives the sheet metal part in the marginal region of the hole 500 in a ring groove 508 formed between the rivet bead 506 and the base surface of the ring-like recess 212 in the broad side 3.

Although the hollow cylindrical projection of the hollow body element of the invention is not provided with an undercut, it can nevertheless be attached in self-piercing manner to a sheet metal part if this takes place in two stages. In a first stage or station the hollow cylindrical projection is used with a suitable piercing die which is arranged at the other side of the sheet metal part in order to punch a hole in the sheet metal part and to remove the piercing slug through the central passage of the piercing die (not shown). Thereafter, the hollow body element remains "suspended" in the sheet metal part and indeed as a result of the hole friction of the hollow cylindrical projection, and/or of the features or ribs providing security against rotation insofar as these engage in the rim of the hole. In a second stage or station the rivet section formed by the hollow cylindrical projection is beaded over with a suitable riveting die, such as for example riveting die of FIG. 14C, to form a rivet bead.

The form of the hollow body elements in accordance with the invention however also makes it possible to simplify the progressive tool. Since the undercut at the hollow projection is missing, the previously required third station C of the progressive tool in which the flattening of the hollow projection around the undercut takes place, is no longer required, so that this station can be omitted with corresponding simplification of the progressive tool. The form of the progressive tools which result in this way is then shown in FIGS. 15 and 16. The previously used reference numerals of FIGS. 2 and 3 have been used in FIGS. 15 and 16 and will not be described further, since the previous description also applies for these corresponding features or parts.

This simplification signifies that only one reforming station (station A) is required, namely the station in which the upsetting process takes place, in which an elongation, i.e. a longitudinal expansion of the sectional strip can take place which is undesired. In the remaining stations B and D in which the piercing process or the separation process take place no elongation of the sectional strip takes place. These processes in the working stations B and D signify that the corresponding working stations B and D do not count as reforming stations.

A further simplification of the progressive tool is also possible and indeed the upsetting process can take place outside of the progressive tool, for example in a rolling mechanism in accordance with FIGS. 19A to 19C or FIGS. 20A to 20C or FIGS. 21A to 21C which will be explained later. With such an arrangement the rolling mechanism can be coupled to the progressive tool in the sense that the rolling mechanism directly supplies the sectional strip to the progressive tool. This is however not essential. The rolling mechanism can deliver a sectional strip having the required upset features as an intermediate product which can then be supplied in lengths or in the form of a coil to the progressive tool. The rolling can take place in a different factory from the further manufacture in the progressive tool. If the upsetting station is not present in the progressive tool then no reforming station is present and the problem of elongation no longer arises. This represents an ideal solution.

Figure 17:
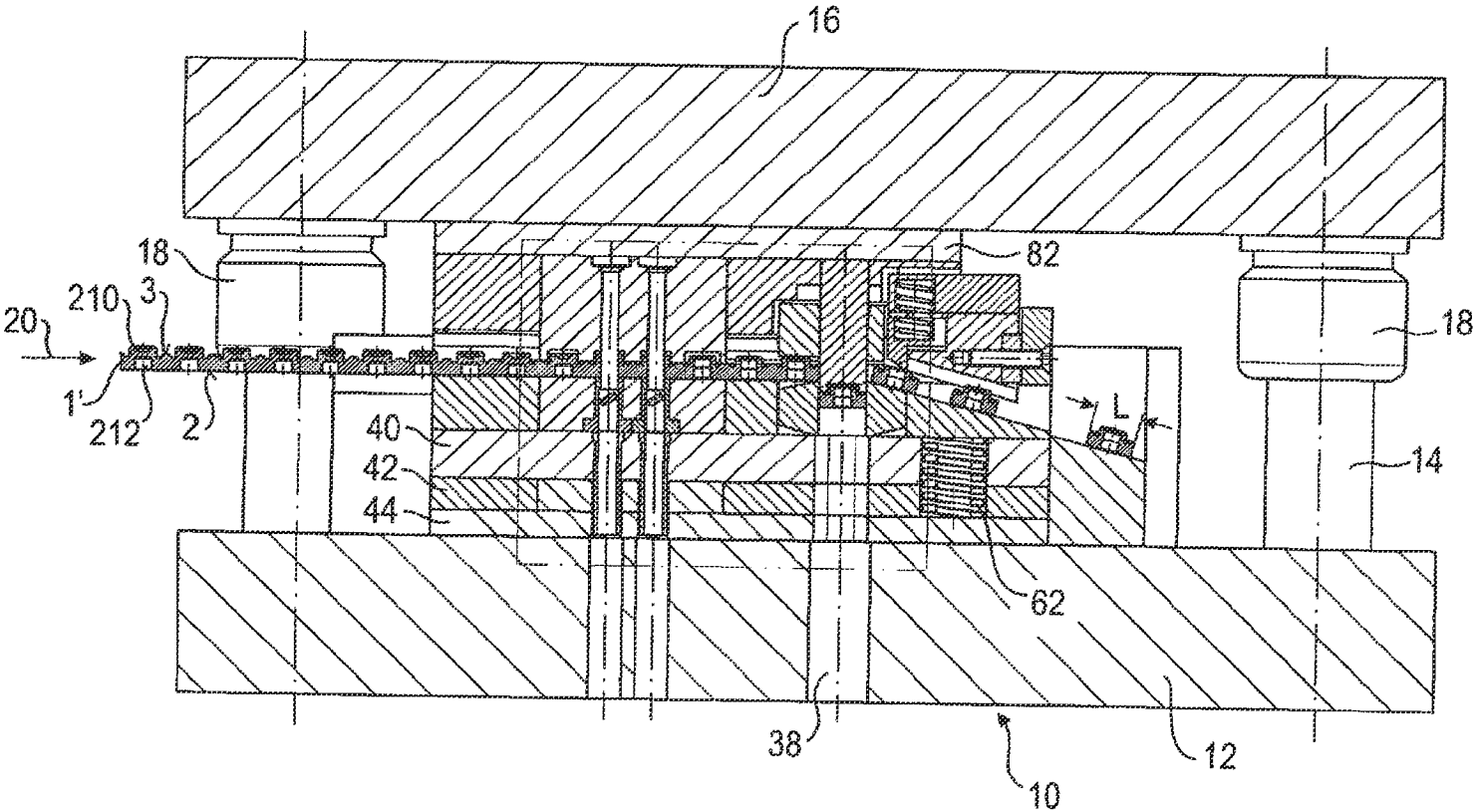
Figure 18:
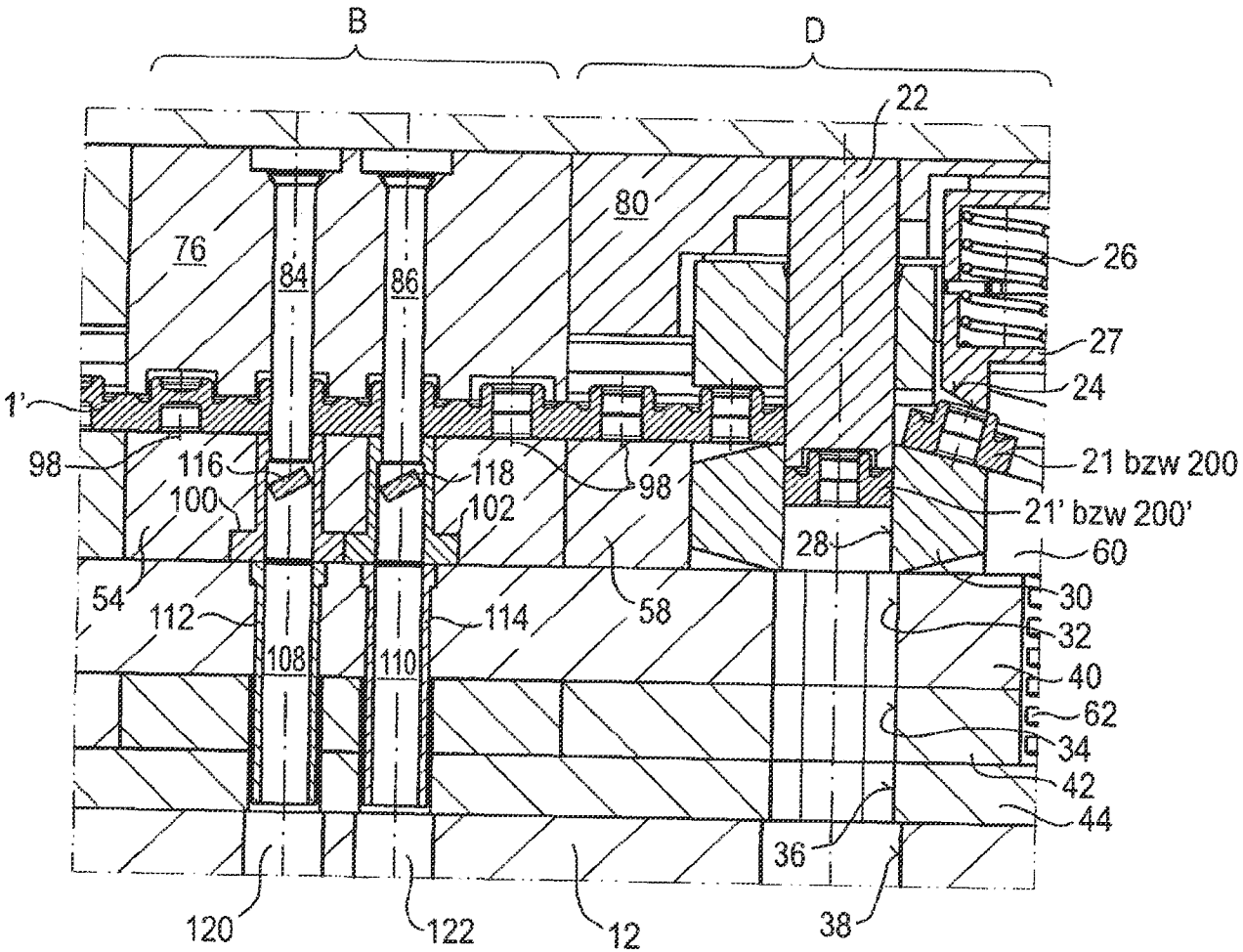
Figure 23A:
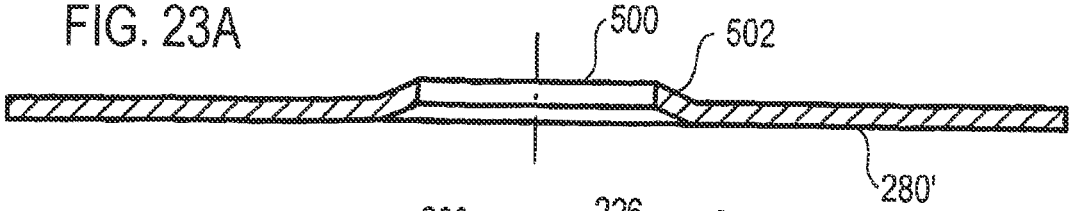
Figure 23B:
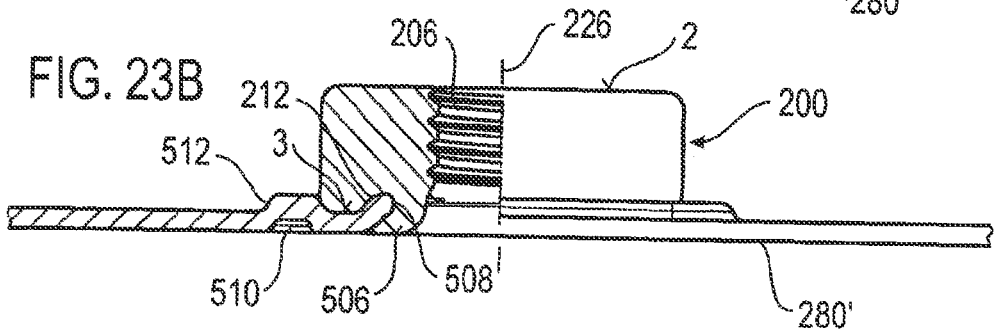
Figure 23C:
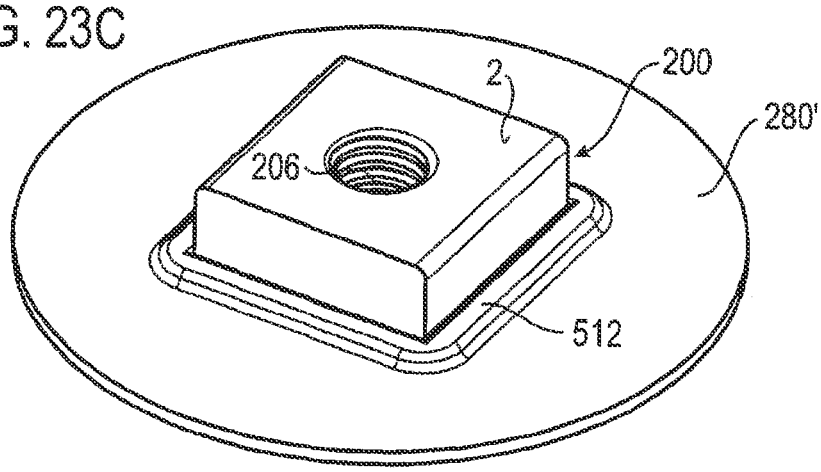
Figure 23D:
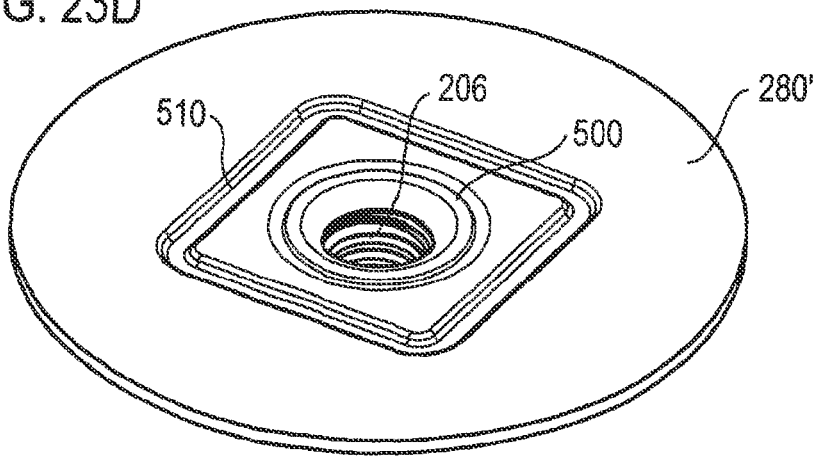
Figure 24A:
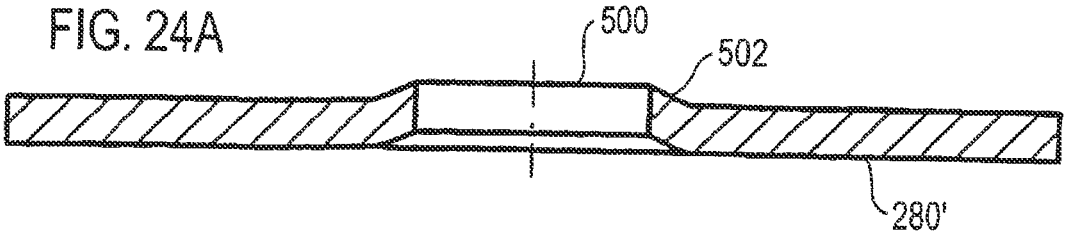
Figure 24B:
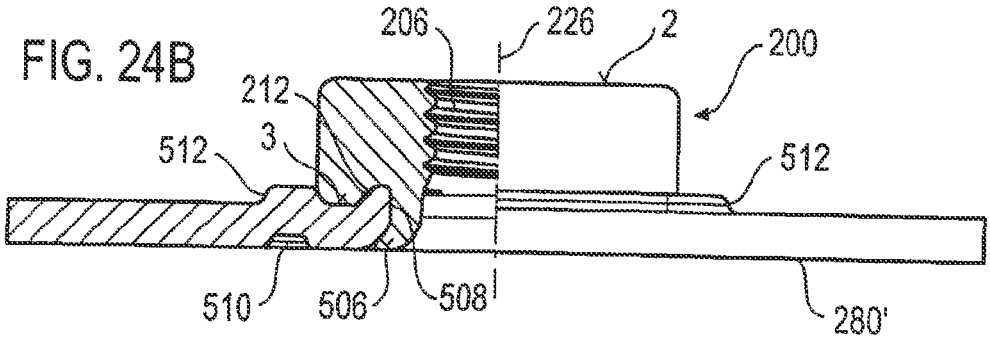
Figure 24C:
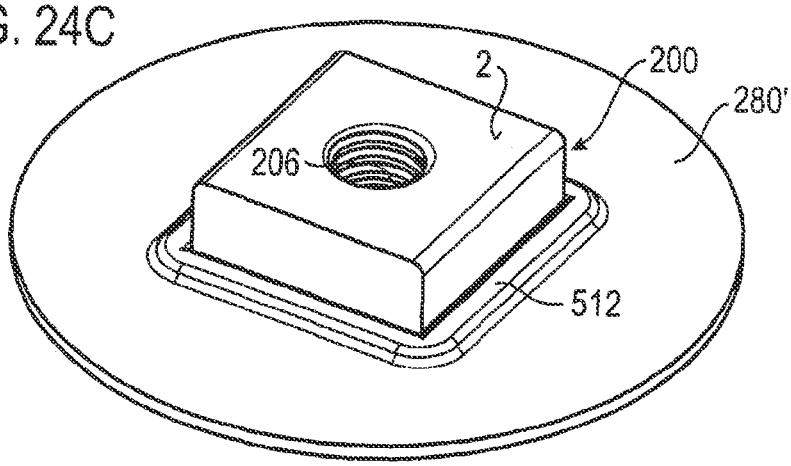
Figure 24D:
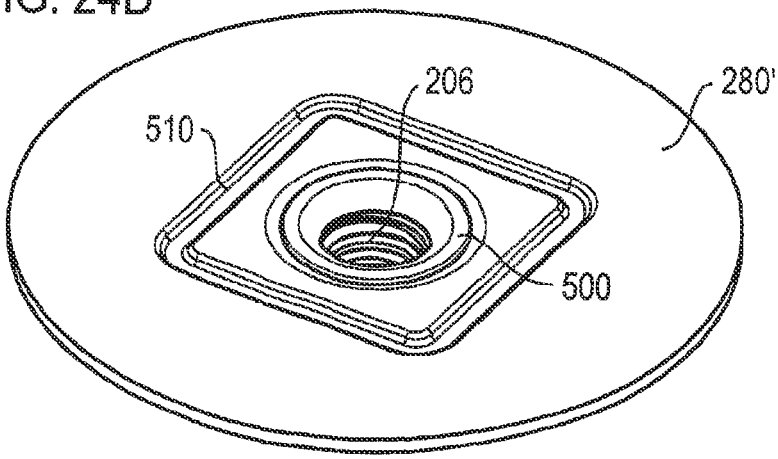

When the upsetting station A is removed from the progressive tool, or not incorporated there in the first place, then the progressive tool is designed as shown in FIGS. 17 and 18. The previously used reference numerals of FIGS. 2 and 3 also been inserted into FIGS. 17 and 18 and will not be de-scribed further, since the prior description also applies for the corresponding features or parts.

In FIGS. 19A to 19C the rolling mechanism is designed in order to manufacture, from an ingoing sectional strip 1 having an at least substantially rectangular cross-section with a first broad side 2 and an oppositely disposed broad side 3, an outgoing sectional strip 1' of regularly alternating section portions which forms the ingoing strip for the progressive tool of FIGS. 17 and 18. For this purpose the outgoing sectional strip 1' consists of alternating section portions consisting of first section portions which have at least substantially the cross-sectional shape of the ingoing sectional strip 1 and of second section portions which are manufactured from the ingoing sectional strip 1 and which each have a cylindrical recess 208 at the first broad side and a hollow cylindrical projection 210 surrounded by a ring-like recess 212 at the second broad side 3.

The rolling mechanism consists of a first roll 600 and of a second roll 602 which are of disk-like shape, of which however only portions are shown and indeed in a perspective illustration in FIG. 19A, partly in a side view and in a radial section plan in FIG. 19B and in an enlarged representation in the region of the clamping gap in FIG. 19C (with the drawings of FIGS. 20A to 20C and 21A to 21C being drawn in corresponding manner). The rolls 600 and 602 are synchronized with one another and run in opposite directions of rotation 604 and 606. The ingoing sectional strip 1 is reformed in a gap region 608, i.e. in the clamping gap 610 between the rolls. The first roll 600 has a plurality of projections 612 arranged at regular angular spacings with a shape which is complementary to that of the cylindrical recess 208. The second roll 602 likewise has a plurality of shaped parts or shaped regions 614 arranged at the same spacings as the projections of the first roll and which each have a central section with a shape 616 which is complementary to the shape of the hollow cylindrical projections 210 and also a ring projection 618 surrounding the central section with a shape which is complementary to the shape of the ring-like recess 212 surrounding the hollow cylindrical projection 210.

In the rolling mechanism of FIGS. 20A to 20C or 21A to 21C the rolls are similarly designed except that the roll 602 lacks a shaped projection such as 618 of FIG. 19C which leads to the formation of a ring recess in the sectional strip. This signifies that the ring recess 212 which is desired for the hollow body elements has to be manufactured in the progressive tool, for example in that the formation of the ring recess 212 is combined with the piercing process (and can hereby contribute to the correction of the wall of the hole) or in that this takes place in a different working station (for ex-ample in an additional forming station).

In all rolling mechanisms it is favourable when the projection 612 of the first roll 600 and the shaped parts or shaped regions 614 of the second roll 602 have relieved portions such as 620, i.e. a somewhat ball-like shape which differs from a circular cylindrical shape and which ensures that a clean roll-off movement takes place at the rolls, i.e. no collisions can take place of the rolls with the sectional strip during run-out of the emerging sectional strip.

The volume of sectional strip material displaced by each projection of the first roll should advantageously correspond at least substantially to the material volume of the material displacement at the side of the second roll, i.e. to the volume which is comprised as follows: the volume of the hollow cylindrical projection 210 plus the volume of a base region of the projection which extends beyond the second broad side and less the volume of any ring-like recess 212 surrounding the projection.

Finally, the projection 612 of the first roll 600 and/or of shaped parts 614 of the second roll can be formed by respective inserts of the respective roll 600 or 602, as shown in FIGS. 19 to 21, with the shaped parts 614 not being realized as inserts only in FIGS. 21A to 21C. The use of inserts facilitates the exchange of worn or broken inserts without having to exchange the entire roll.

Although the present invention is intended for the manufacture of elements which are rectangular or square in their external outline it could also be used for the manufacture of elements which are polygonal, oval or circularly round in their external outline, or of elements with a different form, providing the tools that are used are designed in order to manufacture the desired outline shape from the sectional strip, for example through the use of correspondingly designed punching tools.

Thus a method for the manufacture of hollow body elements 200, such as nut elements for the attachment to components normally consisting of sheet metal 280, is provided in accordance with the invention, in particular for the manufacture of hollow body elements having an at least substantially square or rectangular external outline 202 by cutting elements to length from a section present in the form of a sectional bar 1 or of a coil after prior punching of holes 204 into the section, optionally with subsequent formation of a thread cylinder 206 are using a progressive tool 10 having a plurality of working stations A, B and D or B and D respectively, in which respective operations are carried out. The method of the invention is characterized by the following steps:

a) that in a first step starting from a section 1 of rectangular cross-section an upsetting process is carried out which leads to a cylindrical recess 208 at a first broad side 2 of the section and to a hollow cylindrical projection 210 at a second broad side 3 of the section lying opposite to the first broad side 2, with the projection being surrounded by a ring-like recess 212, b) that in a second step a web 214 remaining between the base 214 of the cylindrical recess and the base 216 of the hollow cylindrical projection 210 is pierced or punched out to form a through-going hole 204, c) that in a third step the hollow body elements 200 are separated from the section and optionally provided with a thread 200.

The upsetting process can, as explained above, take place in the progressive tool or in a previous working process, for example in a rolling mechanism.

During the upsetting progress of step a) the diameter of the cylindrical recess 208 and the internal diameter of the hollow cylindrical projection 210 should be made at least substantially the same.

During the piercing of the web in accordance with step b) a hole 204 with a diameter is preferably produced which corresponds at least substantially to the diameter of the cylindrical recess 208 and to the internal diameter of the hollow cylindrical projection 210.

In the manufacture of the hollow cylindrical projection 210 this is preferably so designed that it projects beyond the second broad side of the section.

During the upsetting process in accordance with step a) a ring-like raised portion 260 can be formed at the first broad side (2) of the section around the cylindrical recess 208.

During the upsetting process in accordance with step a) features 272 pro-viding security against rotation can be formed externally at the hollow cylindrical projection 210 and/or internally in the region of the ring recess 212 around the hollow cylindrical projection 210.

The features providing security against rotation can be formed by ribs 272 and/or grooves at the radially outer side of the hollow cylindrical projection 210.

The features providing security against rotation are preferably formed by ribs 272 which extend in the axial direction along a part of the hollow cylindrical projection 210 between the base of the ring-like recess 212 and a point between the second broad side of the section and the free end of the hollow cylindrical projection.

In this respect the ribs 272 providing security against rotation can have a radial width which corresponds at least substantially in the range between 40% and 90% to the maximum radial depth of the undercut 244.

In distinction to the previous method a forming process can be carried out in step a), likewise starting from a section 1 of rectangular cross-section, in which optionally no cylindrical recess 208 is provided at the first broad side 2 of the section 1 but which leads, at the second broad side 3 of the section 1, to a recess 212' at the second broad side 3 of the section which is preferably of polygonal and in particular square shape in plan view, which surrounds the hollow cylindrical projection 210, which is formed partly from the material displaced during formation of the recess 212' and partly from the material displaced through the formation of the hollow space of the hollow cylindrical projection 210, with the recess 212' being provided with a ring surface or a plurality of ring surfaces set obliquely to the central longitudinal axis of the hollow body element and, in the second step b) with the material between the first broad side 2 of the section 1 and the base 216 of the hollow cylindrical projection 210 being pierced or punched out to form a through-going hole 204.

A hollow body element in accordance with the invention for attachment to a component 280 normally consisting of sheet metal 280 and having an in particular at least substantially square or rectangular external outline having a first broad side 2 and a second broad side 3 with a hollow cylindrical projection 210 without undercut which projects beyond the second broad side 3 and is surrounded by a ring recess 212 in the second broad side and also having a hole 204 which extends from the first broad side 2 through the hollow cylindrical projection which forms a rivet section and/or through the piercing section 222, with the hole optionally having a thread cylinder 206, is characterized in that features 272 providing security against rotation are formed outwardly at the hollow cylindrical projection 210 and j or inwardly in the region of the ring recess 212 around the hollow cylindrical projection 210 and in that no undercut is provided at the hollow cylindrical projection.

The features providing security against rotation are preferably formed by ribs 272 and/or grooves at the radially outer side of the hollow cylindrical projection 210.

The features providing security against rotation can be formed by ribs 272 which extend in the axial direction along the hollow cylindrical projection 210.

The ribs 272 providing security against rotation can have a radial width which lies at least substantially in the range between 10% and 60% of the wall thickness of the hollow cylindrical projection 210.

The features providing security against rotation can also be provided in the form of radially extending ribs 272 which bridge the ring recess. An embodiment of this kind can be found in the FIGS. 22A-22D which will be later explained in more detail.

Moreover, the features providing security against rotation can be provided in the form of obliquely set ribs providing security against rotation which extend in the radial direction over the ring recess and in the axial direction along the hollow cylindrical projection.

Furthermore, the features providing security against rotation can be pro-vided in the form of recesses which are arranged in the obliquely set surface of the ring recess.

The second broad side 3 lies radially outside of the ring recess 212 in a plane, i.e. apart from any rounded features or chamfers at the transitions into the side flanks (2',3') of the hollow body element, and thus has no bars, grooves or undercuts in the region outside of the ring recess 212.

The ring recess 212 is preferably designed with an outer diameter which is only somewhat smaller than the smallest transverse dimension of the hollow body element 200 which is rectangular in plan view, whereby the ring recess forms webs with the second broad side of the section which remain, at the narrowest points in the plane of the second broad side, in the range from 0.25 mm to 1 mm, preferably of about 0.5 mm.

Furthermore, the invention provides a hollow body element for attachment to a component 280 normally consisting of sheet metal having an in particular at least substantially square or rectangular external outline, with a first broad side 2 and a second broad side 3, with a hollow cylindrical projection which projects beyond the second broad side 3 and is surrounded by a ring recess 212' in the second broad side and also with a hole 204 which extends from the first broad side 2 through the hollow projection or through the punching section 210, with the hole optionally having a thread cylinder 206 and the element being characterized in that the ring recess 212' is polygonal and in particular square in plan view and in that the ring recess 212' is provided with a surface or a plurality of surfaces set obliquely to the central longitudinal axis of the hollow body element and the hollow cylindrical projection 210 has no undercut.

A component assembly in accordance with the invention consists of a hollow body element 200 of the above-named inventive kind which is attached to a component, for example to a sheet metal part 280, with the material of the component or of the sheet metal part 280 contacting the surface of the ring recess 212 of the hollow body element, the surface of the features 272 providing security against rotation and also the surface of the hollow cylindrical projection 210 which has been beaded over to form a rivet bead.

In this connection, the axial depth of the ring groove 282 in the sheet metal part is so selected in dependence on the length of the hollow cylindrical projection 210 and the thickness of the sheet metal part 280 that the rivet bead does not project or only fractionally projects beyond the side of the sheet metal part which is remote from the body of the hollow body element 200 and is present in the region below the second broad side 3 of the hollow body element around the ring recess 212 of the hollow body element.

The second broad side 3 of the hollow body element 200 in the region around the ring recess 212 of the hollow body element 200 is preferably at least substantially not or at most fractionally pressed into the sheet material.

A progressive tool in accordance with the invention for the manufacture of hollow body elements 200 such as nut elements for attachment to components normally consisting of sheet metal, in particular for the manufacture of hollow body elements having an at least substantially square or rectangular external outline 202 by cutting individual elements by length from a section 1 present in the form of a sectional bar or of a coil after prior piercing of holes 204 into the section, optionally with the subsequent formation of a thread cylinder 206, wherein, for the section or for a plurality of sections arranged alongside one another, in each case two operations are carried out simultaneously in each working station for each stroke of the progressive tool, is characterized in that a piercing process can be carried out in a working station B and the separation of the hollow body elements from the section or from each section can be carried out by means of the cut-off punch in a subsequent working station D.

In this connection an upsetting process can be carried out in a first working station A for example for the formation of a cylindrical recess 208 at a first broad side of a section which is at least substantially rectangular in cross-section and of a hollow cylindrical projection surrounded by a ring-like recess 212 at a second broad side of the section opposite to the first broad side.

In this connection the piercing process is carried out to pierce a web remaining after the upsetting process between the base of the cylindrical recess 208 and the central passage of the hollow cylindrical projection.

The progressive tool is designed in a variant in order to operate with an ingoing sectional strip 1 having at least substantially rectangular cross-section with a first broad side 2 and a second broad side 3 lying generally opposite to it which consists of regularly alternating sectional portions of the sectional strip 1 and sectional portions which are manufactured from the sectional strip 1 and which each have a cylindrical recess 208 at the first broad side and a hollow cylindrical projection 210 surrounded by a ring-like recess 212 at the second broad side 3.

As mentioned above the possibility also exists, with a hollow body element 200 in accordance with the invention, of designing the ribs 272 providing security against rotation in such a way that they bridge the ring-like groove 212 in the radial direction. A design of a hollow body element 200 of this kind is shown in FIGS. 22A-22D. The single important distinction over the element in accordance with FIGS. 13A-13D lies in the fact that the ribs 272 providing security against rotation bridge the ring-like groove 212 in the radial direction as shown here, with the material which forms the ribs 272 providing security against rotation in this embodiment merging via clear radii into the rivet section 210 and also into the base region and into the outer oblique side of the ring-like recess 212. The top sides of the ribs 272 providing security against rotation in FIG. 22D lie fractionally set back relative to the second broad side 3 of the element can, however, also lie flush with this side. Here also one can see that the inner cylindrical side 288 of the cylindrical rivet side 210 has an internal diameter which is somewhat larger than the outer diameter of the thread 206 in order, on the one hand in the riveted in state, to facilitate the introduction of a bolt coming from below into the thread 206 in FIG. 22C, with the internal diameter 288 forming, via a conical region 288", the thread entry and merging into the thread, which also serves for the centring of a bolt on its introduction into the thread 206.

In this embodiment the radius of the outer side of the cylindrical rivet section 210 is made somewhat more pronounced than in the embodiment of FIGS. 13A-13D. The inner conical surface 288' is however smaller. Here it is shown slightly rounded, could however also be designed in manner known per seas a conical cutting surface.

In FIG. 22C one can see the ribs 272 providing security against rotation at the left and the right of the cylindrical rivet section in a perspective side view, with the hatched representation reproducing a perspective view of the radii with which the material of the ribs 272 providing security against rotation, which lie beneath behind the plane of the sectional drawing of FIG. 22C, merge into the oblique surface of the axial groove, i.e. of the ring-like recess 212. A possible way of attaching the hollow body elements in accordance with FIGS. 22A-22D to a sheet metal part is shown in the drawings of FIGS. 23A-23D for a relatively thin sheet metal part 280' and in the FIGS. 24A-24D for a relatively thick sheet metal part. The attachment itself takes place similarly to the method which was already de-scribed in conjunction with the FIGS. 14A to 14D, i.e. also with the aid of a die button such as 504, with the die button here having, in addition to the central post region or to the central raised portion in accordance with FIG. 14C which are responsible for the formation of the rivet bead 506, a square raised portion in plan view around this central post having a cross-sectional shape corresponding to the shape of the recess 510 of the FIG. 23B and a shape in plan view complementary to the peripheral shape of the groove 510 in accordance with FIGS. 23A-23D. This in plan view square shape of the external raised portion of the die button leads precisely to the recess 510 in accordance with FIGS. 23A-23D and FIGS. 24A-24D and at the same time to the corresponding raised portion 512 in these Figures, which has a corresponding square shape and narrowly surrounds the hollow body element 200 in the region of the attachment to the sheet metal part 280'. In this way an additional security against rotation is provided, in addition to the security against rotation which arises through the ribs 272 (not shown in FIGS. 23A-23D or 24A-24D but present there). Under some circumstances the ribs 272 providing security against rotation could be omitted or could be made less high and the square raised portion 512 which surrounds the outer side of the hollow body element 200 can be used as the sole feature providing security against rotation.

The square raised portion 512 in plan view also takes care of an optically attractive transition of the lower side of the hollow body element 200 into the sheet metal part 280'.

Through a comparison of FIGS. 23A-23D and 24A-24D it is evident that one and the same hollow body element 200 can be used with sheet metal parts 280' of different thicknesses and nevertheless ensures a high quality attachment to the sheet metal part 280'. In this manner it is possible to succeed in covering a range of sheet metal thicknesses between for example 0.6 and 3.5 mm (without restriction) with only two different embodiments of the hollow body element 200 in the sense of different lengths of the hollow rivet section 210. It is also advantageous that the lower side of the sheet metal part in the region of the element and also the lower side of the rivet bead 506 lie in a plane with the underside of the sheet metal part outside of the element, which is favorable for the screwing on of a further component to the lower side of the sheet metal part. This can be achieved irrespective of the thickness of the sheet metal part within the permissible range for the once specified length of the rivet section.

The method for the manufacture of the hollow body elements 200 in accordance with FIGS. 22A-22D corresponds largely to the previously de-scribed method and will now be briefly described in more detail with reference to FIGS. 25A-25F and 26 and 27.

Figure 25A:
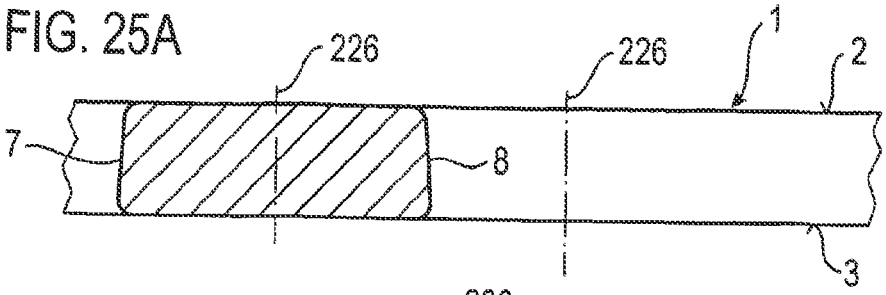

Referring to the drawings of FIGS. 25A-25F one can see in FIG. 25A that the sectional strip from which the elements are manufactured is a substantially rectangular strip, but that the side surface 7 and 8 stand slightly oblique to one another, i.e. are inclined, and indeed in such a way that they have a smaller spacing from one another in the region of the first broad side of the section than in the region of the second broad side 3 of the section. This results from the hatched region of the sectional strip 1 in FIG. 25A which represents the cross-section through the strip.

Figure 25B:
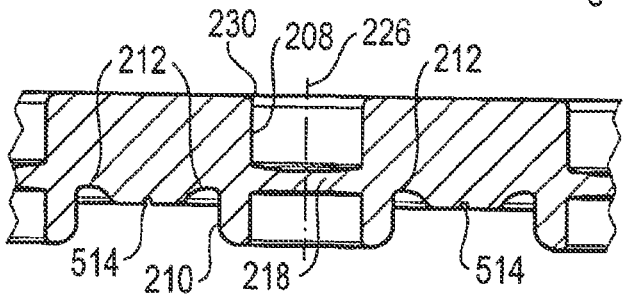
Figure 25C:
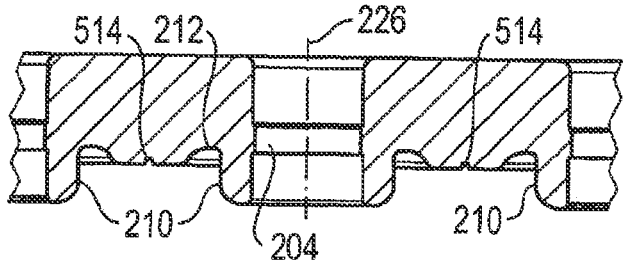
Figure 25D:
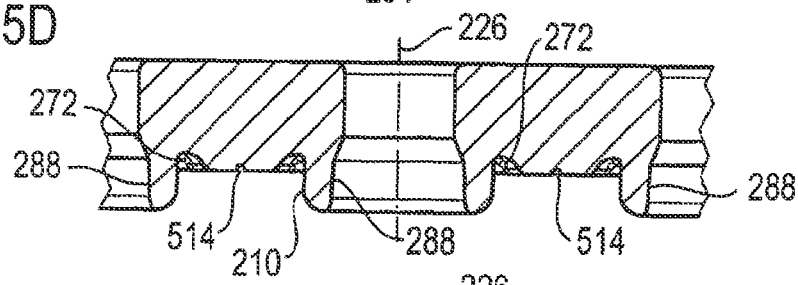
Figure 25E:
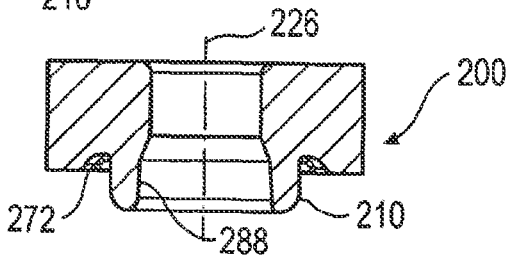
Figure 25F:
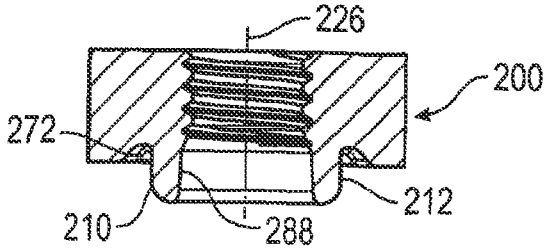

The FIG. 25B shows the sectional strip after carrying out the upsetting process in which the cylindrical recess 208 with the radius 230 is formed in the first broad side 2 of the section and the cylindrical rivet section 210 and also the ring groove 212 surrounding it is produced in the second broad side of the section. Although it cannot be seen in the representation of FIG. 25B the ribs 272 providing security against rotation which bridge the ring-like groove 212 are co-produced in this first reforming step. Furthermore notches such as 514 are produced in the broad side 3 of the sectional strip which extend perpendicular to the longitudinal direction of the sectional strip, i.e. from one narrow side 7 to the other narrow side 8.

These notches form weakened points which facilitate the later separation of the individual elements from the sectional strip. They form in FIG. 25B the boundary of the central middle part of the strip which later forms a hollow element such as 200, with a part of the further hollow body element being visible to the left of the left hand notch 514 and a part of a yet further hollow body element 200 being visible to the right of the right hand notch 514.

Figure 26:
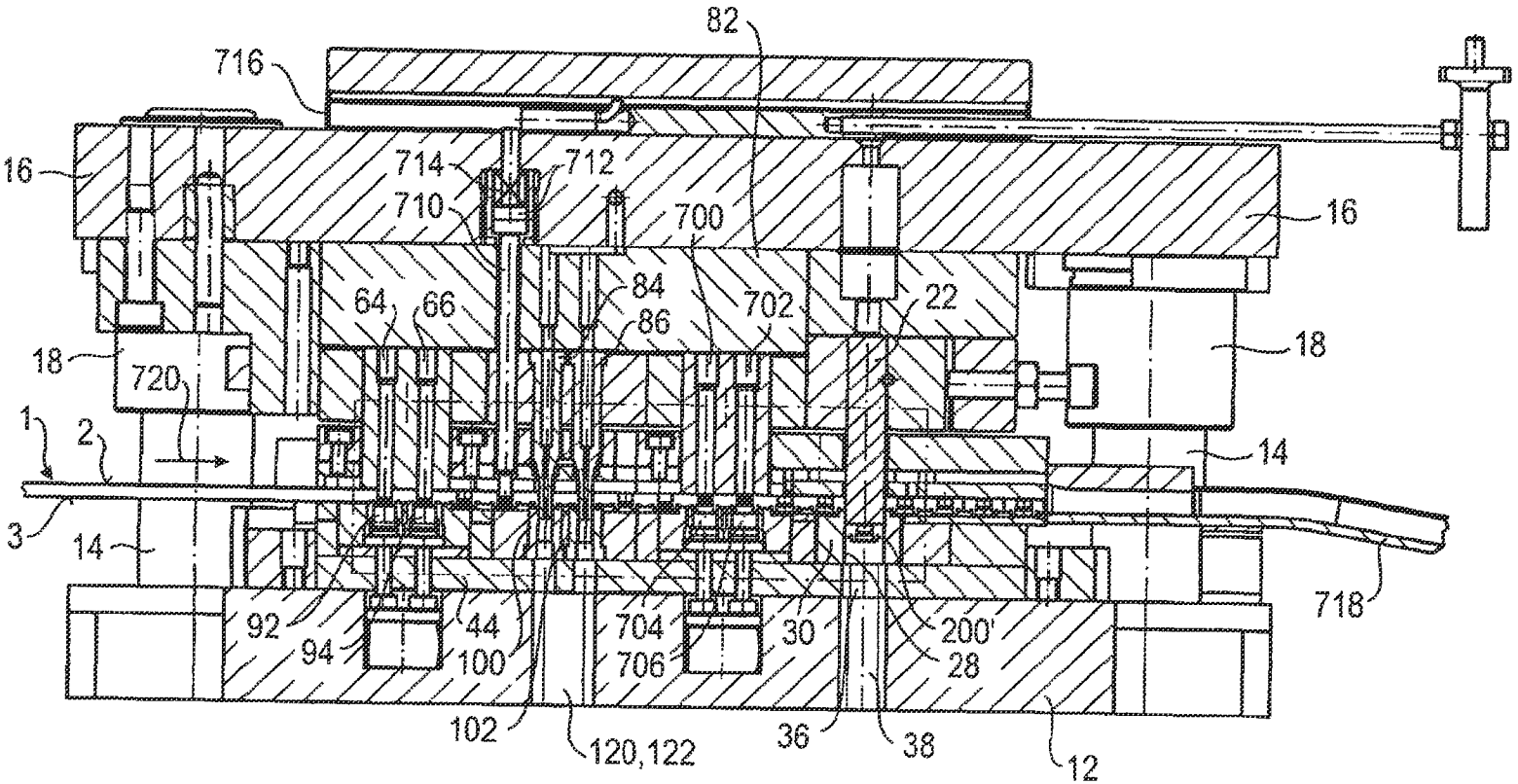
Figure 27:
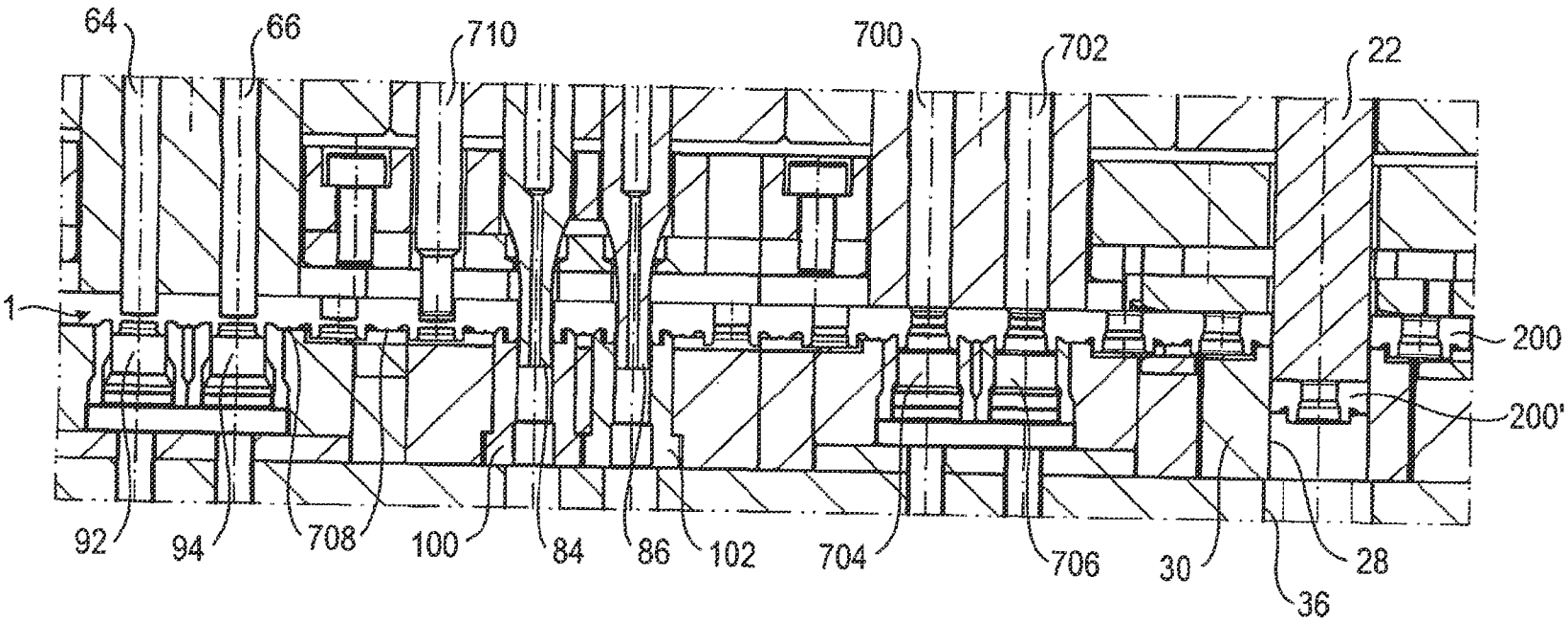

The progressive tool for the manufacture of the elements of FIGS. 22A-22D corresponds to the manufacturing steps shown in FIGS. 25A-25F and de-scribed in this connection and is shown in FIG. 26 and to an enlarged scale in the relevant region of the progressive tool in FIG. 27.

Figure 15:
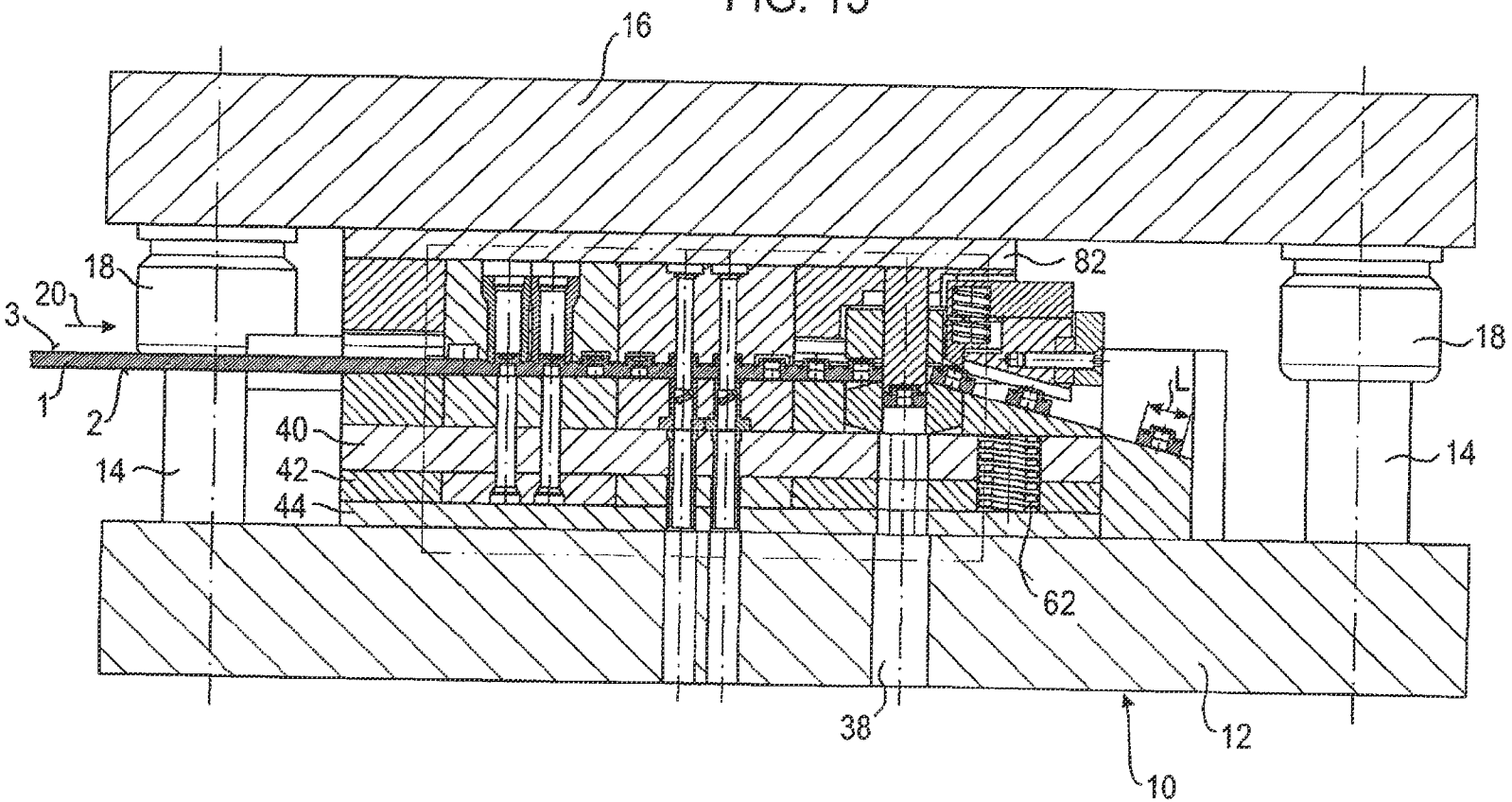
Figure 16:
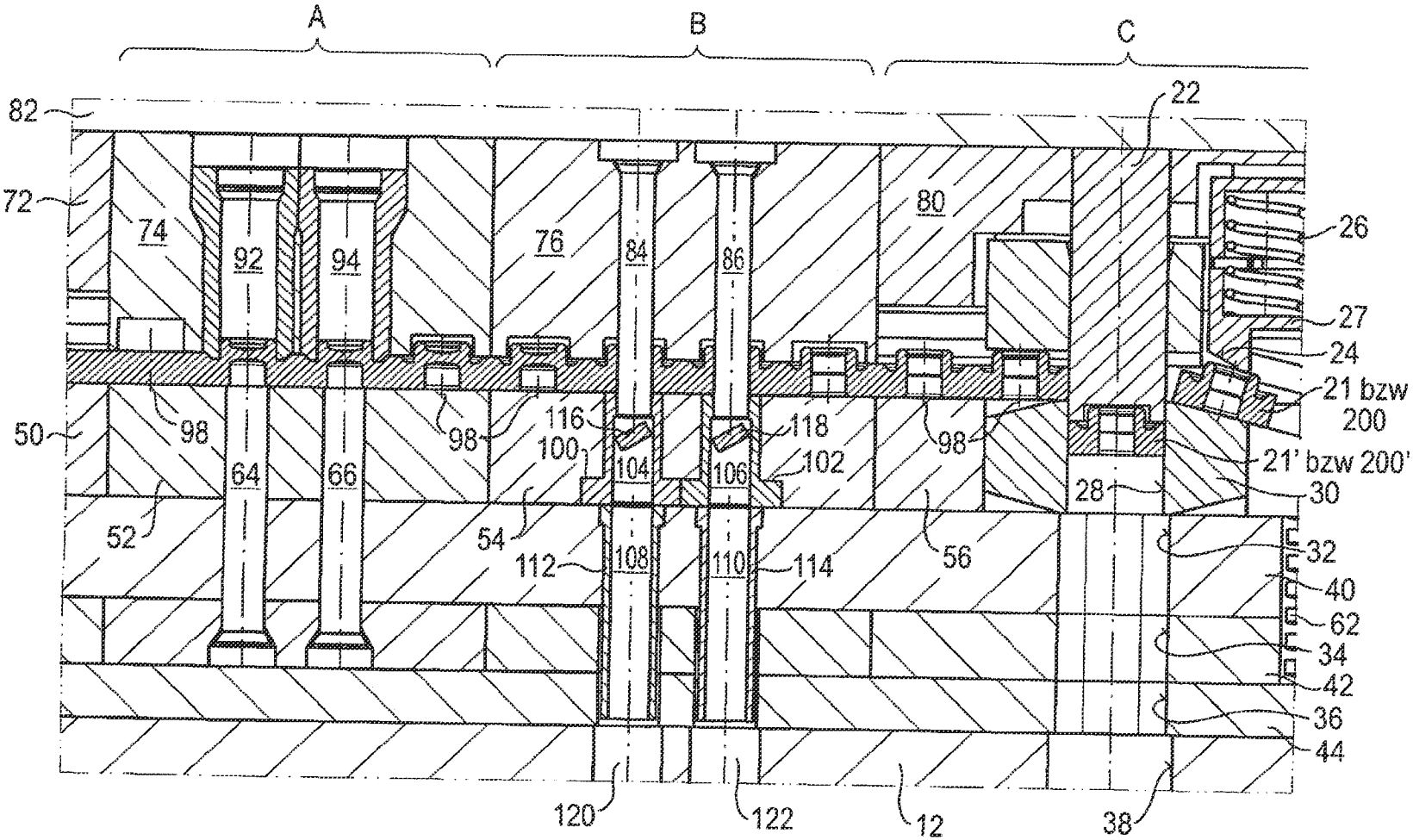

The progressive tool of FIGS. 26 and 27 corresponds generally to the progressive tool of FIGS. 15 and 16 and, as explained above, for this reason the same reference numerals will also be used for corresponding parts or parts having corresponding functions. In this description of the progressive tool in accordance with FIGS. 26 and 27 essentially only the important differences with respect to the progressive tool in accordance with FIGS. 15 and 16 or to the other already described progressive tools will be mentioned.

Whereas, in the progressive tool of FIGS. 15 and 16, the upsetting punches 64, 66 are arranged beneath the sectional strip 1 and the corresponding die buttons 92, 94 above the sectional strip 1, in the example of FIGS. 26 and 27 the upsetting punches 64, 66 are arranged above the sectional strip 1 whereas the corresponding die buttons 92, 94 are located below the sectional strip. In this connection the support of the upsetting die but-tons 92, 94 in the embodiment of FIGS. 26 and 27 is affected somewhat differently than in the embodiment of FIGS. 15 and 16. However, the die buttons are also arranged here in a fixed position in the lower tool.

The sense of the previously mentioned inclined arrangement of the side surfaces 7 and 8 in the sectional strip is that the sectional strip is expanded in the width by the upsetting punches 64, 66 in the upper region adjacent to the cylindrical hollow space 208 produced by the upsetting punches 64, 66, whereby the narrow sides 7 and 8 tend to adopt a position perpendicular to the upper and lower broad sides 2 and 3, which then takes care of an orderly guidance of the sectional strip on the further path through the progressive tool.

In accordance with the progressive tool in accordance with FIGS. 15 and 16 the hole punches 84 and 86 are arranged above the sectional strip 1 in the embodiment of FIGS. 26 and 27 whereas the corresponding die buttons 100, 102 are located beneath the sectional strip 1.

As a further station in the progressive tool in accordance with FIGS. 26 and 27 two dilation dies 704, 706 are provided which serve to expand the cylindrical rivet section 210 and determine the end design of the broadened hollow cylindrical region 288 with the conical region 288" which forms the thread entry and the conical or rounded entry region 288' below the sectional strip. Above the sectional strip there are then located two punches 700, 702 which engage during the closing of the press into the cylindrical recess 208 which was already formed earlier, and which take up the forces acting from the dilation dies 704, 706 in the direction of the longitudinal axis 226 of the individual hollow body elements. They can also serve for the correction of the shape of the hollow body element in the region of the thread run-out and/or for the calibration of the internal diameter of the region 208 or of the passage hole 204 prior to carrying out the thread cut-ting process, which first takes place after the separation of the individual elements from the sectional strip by the cut-off punch 222 and the removal of the individual hollow body elements from the press.

In deviation from the previous progressive tool in accordance with FIGS. 15 and 16 no spring-loaded cam is used here for the removal of the elements out of the region of the cut-off punch but rather a guide channel 118 which can be plugged in comes into use which leads the elements which leave the progressive tool in the running direction of the sectional strip out of the region of the cut-off punch. The second hollow body element 200' which is separated from the sectional strip for each stroke of the press is lead out as previously through a passage bore 28 in the cut-off die 30 and through an enlarged bore 38 of the lower plate 12 and can for example be lead sideways out of the press via a slide after leaving the plate 12 or within the plate 12.

In this embodiment the small raised portions at the reference numeral 708 should also be noted. These raised portions serve for the formation of the notches such as 514. The element with the reference numeral 710 should also be noted. This is a position sensor which dips into a cylindrical hollow space 208 in order to ensure that the sectional strip has hitherto been orderly processed and is located at the correct position in the progressive tool.

If the sensor 710 does not dip by the amount provided into such a hollow space for each stroke of the press, but rather if it, for example, strikes the upper broad side of the sectional strip adjacent to such a hollow space or in the absence of such hollow space, because this is simply not present, for example since the upsetting punches such as 64, 66 are worn or broken, then the sensor 710 is shifted during closing of the press upwardly against the force of the spring 714, which acts on the collar 712 of the sensor 710, and thereby comes into the vicinity of the proximity sensor 716 which transmits a corresponding signal which serves for the immediate stopping of the press. The reason for the disturbance can then be investigated and the press can be set into operation again after carrying out the required correction or repair.

During the opening stroke of the press the upper tool must be lifted upwardly sufficiently far that the upsetting punches 64, 66, the sensor 710, the piercing punches 84, 86 and the support punches 700, 702 as well as the cut-off punch 22 come free from the upper side 2 of the sectional strip, with the sectional strip having to be lifted so far that it comes free from the projection parts of the lower tool such as the upsetting dies 92, 94, the projection 708 forming the notches, the piercing dies 100, 102 and the fixed dilation dies 704, 706 as well as the cut-off die 30. For each stroke of the press the sectional strip is shifted to the right in accordance with the arrow 720 by a length corresponding to the length of two hollow body elements 200. In this embodiment each station corresponds to a length which represents an integral multiple of the length of the individual hollow body element 200. Here, as shown in the drawings, a plurality of empty stations are provided in order to provide constructional space for the individual tools of the progressive tool. Here a considerable re-shaping actually only takes place in the region of the upsetting punches 64, 66 in the upsetting die 92, 92 so that problems with the elongation of the sectional strip within the progressive tool are not to expected, particularly, since a part of the extension which takes place in the region of the upsetting punches and of the upsetting dies is taken up by the inclined position of the sides 7, 8 of the sectional strip and thus do not result in an elongation of the sectional strip.

In all embodiments, all materials can be named as an example for the material of the section and of the functional elements which are manufactured from it which, in the context of cold deformation, reach the strength values of class 8 or higher in accordance with the ISO standard, for example a 3582 alloy in accordance with DIN 1654. The fastener elements formed in this way are suitable amongst other things for all normal steel materials for drawing quality sheet metal parts and also for aluminum or its alloys. Also aluminum alloys, in particular those of high strength, can be used for the section or the functional elements, for example AlMg5. Sections or functional elements of higher strength magnesium alloys such as for example AM5O also enter into consideration.

Although the present invention is intended for the manufacture of elements which are rectangular or square in external outline, it can also be used for the manufacture of elements which are polygonal, oval or circularly round in the external outline or of such elements having a different form, provided that tools that are used are designed in order to manufacture the desired peripheral shape from the sectional strip, for example by the use of correspondingly designed punching tools.

The invention claimed is:

1. A hollow body rivet element for attachment to a component of sheet metal (280), said hollow body element having one of an at least substantially square external outline and an at least substantially rectangular external outline, having a first broad side (2) and a second broad side (3), the hollow body element having a hollow cylindrical projection (210) which projects beyond the second broad side (3), the hollow cylindrical projection being surrounded by a ring recess (212) in the second broad side, the hollow cylindrical projection having a substantially constant diameter from its distal end to the recess the ring recess including a portion having a surface substantially parallel with the second broad side and being bounded by a wall in the hollow body element, the wall merging into the second broad side, the hollow body element also having a hole (204) which extends from the first broad side (2) through the hollow cylindrical projection, a first axial portion of said hole having a thread cylinder or being sized for the formation of a thread cylinder and a second axial portion of the hole within the hollow cylindrical projection having no thread, the hollow cylindrical projection containing the second axial portion of the hole being designed as a rivet section that, prior to being deformed to form a rivet bead which clampingly receives the sheet metal component between itself and the wall of the ring recess, has no undercut at an outer surface of the hollow cylindrical projection, the second axial portion of the hole within the hollow cylindrical projection having an internal diameter greater than the first axial portion of the hole and greater than a maximum diameter of a thread cylinder formed in the first axial portion, wherein features (272) providing security against rotation are formed at least one of outwardly at the hollow cylindrical projection (210) and inwardly in the region of the ring recess (212) around the hollow cylindrical projection (210) the features deviating radially from the otherwise substantially constant diameter of the cylindrical projection wherein the ring recess (212) is provided with a ring-like base region (238) which stands at least approximately in a plane parallel to the first and second broad sides (2, 3), merges at the radially inner side with an at least substantially rounded transition (240) into the outer side of the hollow cylindrical projection and merges at the radially outer side into a conical surface (242).

2. The hollow body element in accordance with claim 1, wherein the features providing security against rotation are formed by ribs (272) and/or grooves at the radially outer side of the hollow cylindrical projection (210).

3. The hollow body element in accordance with claim 1, wherein the features providing security against rotation are formed by ribs (272) which extend in the axial direction along the hollow cylindrical projection (210).

4. The hollow body element in accordance with claim 1, wherein the ribs (272) providing security against rotation having a radial width which lies at least substantially in the range between 10% and 60% of the wall thickness of the hollow cylindrical projection (210).

5. The hollow body element in accordance with claim 1, wherein features providing security against rotation are provided in the form of radially extending ribs (272) which bridge the ring recess (212).

6. The hollow body element in accordance with claim 1, wherein features providing security against rotation are provided in the form of obliquely set ribs providing security against rotation which extend in the radial direction across the ring recess and in the axial direction at the undercut of the piercing section.

7. The hollow body element in accordance with claim 1, wherein the features providing security against rotation are provided in the form of ribs providing security against rotation which extend in the radial direction across the ring recess and in the axial direction at the hollow cylindrical projection (210).

8. The hollow body element in accordance with claim 1, wherein the features providing security against rotation are provided in the form of recesses which are arranged in the obliquely set surface of the ring recess.

9. The hollow body element in accordance with claim 1, wherein side flanks extend between edges of the first and second broad sides, the second broad side (3) lies radially outside of the ring recess (212) in a plane apart from any rounded portions or chamfers at transitions into the side flanks of the hollow body element, and thus has no bars, grooves or undercuts in the region outside of the ring recess (212).

10. The hollow body element in accordance with claim 1, wherein the opening of the cylindrical recess (208) at the first broad side of the section is made with a rounded or chamfered entry edge (230).

11. The hollow body element in accordance with claim 1, wherein the opening of the hollow cylindrical projection (210) is provided with a rounded or chamfered run-out edge (234) at its free end.

12. The hollow body element in accordance with claim 1, said hollow body element being rectangular in plan view, wherein the ring recess (212) is designed with an outer diameter which is smaller than a smallest transverse dimension of the hollow body element (200) whereby the ring recess forms webs with the second broad side of the section which remain at the narrowest points in the plane of the second broad side in the range from 0.25 to 1 mm.

13. The hollow body element in accordance with claim 1, wherein the conical surface (242) of the ring recess (212) has an enclosed cone angle in the range between 60 and 120°, preferably of approximately 90°.

14. The hollow body element in accordance with claim 1, wherein the transition from the ring-like region (240) of the ring recess into the conical surface (242) is rounded.

15. The hollow body element in accordance with claim 1, wherein the run-out of the conical surface (242) of the ring recess into the second broad side (3) of the section is rounded.

16. The hollow body element in accordance with claim 13, wherein the enclosed cone angle is approximately 90°.

* * * * *